United States Patent [19]

Irwin

[11] Patent Number: 4,469,026

[45] Date of Patent: Sep. 4, 1984

[54] METHOD AND APPARATUS FOR CONTROLLING DRYING AND DETACHING OF PRINTED MATERIAL

[75] Inventor: John W. Irwin, Loveland, Colo.

[73] Assignee: IBM Corporation, Boulder, Colo.

[21] Appl. No.: 330,866

[22] Filed: Dec. 15, 1981

Related U.S. Application Data

[63] Continuation of Ser. No. 077,480, Jul. 20, 1979, abandoned.

[51] Int. Cl.[3] ..... B41J 3/04; B41J 5/44; B41J 13/08

[52] U.S. Cl. ..... 101/426; 101/232; 101/416 A; 400/126

[58] Field of Search ..... 101/416 R, 416 A, 232; 219/216, 388, 469, 501; 346/75; 355/3 FU; 271/272, 275; 34/1, 4, 41, 49, 151, 152, 25, 30, 148, 52, 48, 56, 162; 400/126

[56] References Cited

U.S. PATENT DOCUMENTS

| | | | |
|---|---|---|---|
| 2,650,291 | 8/1953 | Kinn | 101/416 A |
| 2,911,907 | 11/1959 | Davidson | 101/137 |
| 3,008,242 | 11/1961 | Sites et al. | 101/416 A |
| 3,318,018 | 5/1967 | Steele et al. | 101/416 R |
| 3,519,253 | 7/1970 | Aser et al. | 219/216 X |
| 3,532,855 | 10/1970 | Van Cleave | 219/216 |
| 3,541,959 | 11/1970 | Taffel | 101/363 |
| 3,717,722 | 2/1973 | Messner | 358/78 |
| 3,835,777 | 9/1974 | Krygeris | 101/350 |
| 3,841,215 | 10/1974 | Hasegawa | 101/148 |
| 3,894,343 | 7/1975 | Pray et al. | 34/4 |
| 3,928,718 | 12/1975 | Sagae et al. | 358/296 |
| 3,958,509 | 5/1976 | Murray et al. | 101/426 |
| 4,006,985 | 2/1977 | Hutner | 219/216 X |
| 4,008,955 | 2/1977 | Bar-on | 219/216 X |
| 4,033,263 | 7/1977 | Rehmond | 101/416 A |
| 4,050,075 | 9/1977 | Hertz | 346/75 |
| 4,076,411 | 2/1978 | Crayton et al. | 219/216 X |
| 4,106,061 | 8/1978 | Burnett | 358/296 |
| 4,225,872 | 9/1980 | Marinoff | 271/3 |

FOREIGN PATENT DOCUMENTS

| | | | |
|---|---|---|---|
| 2716705 | 10/1978 | Fed. Rep. of Germany | 101/416 A |

*Primary Examiner*—J. Reed Fisher

*Attorney, Agent, or Firm*—Allan Ratner; Homer L. Knearl

[57] ABSTRACT

Printer having a sheet feed and drum transport assembly, an exit assembly and at least one dryer. Various print parameters or conditions are monitored relating to the drying of the ink on print media. These print parameters include print data density, ink characteristics and ambient humidity. The monitored print parameters are used to control the drying. In addition the monitored print parameters are used to control the detaching of the print media from a rotary transport. In this manner, the printer approaches an optimization of the drying and detaching function with respect to time and energy.

25 Claims, 23 Drawing Figures

PROCEDURE AT LAST INDEX BEFORE DETACH

PROCEDURE WHILE WAITING FOR DECEL TIME

SUBROUTINE GETWET

PROCEDURE CALLED DURING PRINT

METHOD AND APPARATUS FOR CONTROLLING DRYING AND DETACHING OF PRINTED MATERIAL

This application is a continuation of application Ser. No. 077,480, filed July 20, 1979 and now abandoned.

DESCRIPTION

1. Field of the Invention

This invention relates to automatic control of drying of ink or print media. More particularly, the invention relates to monitoring print parameters and controlling the drying and detaching to ensure that the ink and the media are dried while the media is still in a controlled environment.

2. Background Art

In printing with a liquid on a print media, the liquid must be dried before the media may be further handled. The speed with which the printed media dries depends upon the ability of the media to absorb the liquid and the areal density of the liquid applied to the media. If the media does not readily absorb the liquid, or if a large quantity of liquid is applied to a small area of the media, the procedure of allowing the media to dry passively before handling it is either unreliable or too time-consuming.

In the past, passive drying of the media has usually been relied on, but in applications where predetermined conditions indicated additional drying would be required, a fixed energy source has been used to provide the additional drying. For example, U.S. Pat. No. 3,894,343 issued to R. W. Pray et al on July 15, 1975 teaches a heating element for drying inks on a printed web. Such a system must be designed for the worstcase drying problem—the wettest areal density and the least absorptive print media. Any combination of print conditions other than this results in the use of excessive energy to dry the printed web. In addition, as taught in the Pray et al patent, if the web stops, it is necessary to remove the energy source to avoid damaging the web.

The requirement to adjust printing operation in accordance with the print conditions is well known in the art. For example, the Krygeris U.S. Pat. No. 3,835,777 issued Sept. 17, 1974 and the Murray et al U.S. Pat. No. 3,958,509 issued May 25, 1976 teach adjustment of the flow of ink to a printing press in response to sensing of the density of the image. In the Krygeris patent a patch of the printed document is monitored with a densitometer. The signals from the densitometer are analyzed by a computer and used to gate the flow of ink to the press. In the Murray et al patent, a lithographic plate is scanned to determine the density. The print density information is then electronically analyzed and used to adjust the flow of ink to various print zones in the printing area.

In ink jet printers, it is well known to adjust the ink flow in response to the motion of the nozzles relative to the print media. For example, the Messner U.S. Pat. No. 3,717,722, issued Feb. 20, 1973 shows an array of ink nozzles for printing a pattern on cloth. The velocity of flow to the nozzles is adjusted automatically in accordance with the speed of the web under the nozzles, to maintain the same intensity of printed image on the cloth. Similarly, the Hertz et al U. S. Pat. No. 4,050,075, issued Sept. 20, 1977 shows adjustment of the ink flow or of the manner in which the ink is deposited on the print media to compensate for changes in relative movement between ink jet and print media. Thus, the width of a printed trace from the ink jet can be maintained despite relative velocity variations between the ink jet and print media.

Accordingly, while monitoring of print conditions or parameters to adjust the printing operation is well known, the problem of efficiently drying the print media in response to varying print conditions has not been solved.

Other problems that have occurred during the drying of the liquid on the print media related to the stiffness of the paper on its willingness to snap back to its desired flat state after drying. This is particularly important in a drum printer in order to facilitate detachment of the sheet material from the drum (i.e., if the paper does not have sufficient stiffness it is difficult to detach from the drum). Furthermore in drum printers a corona charge assists in holding the leading edge of the paper to the drum and is effective to "tack" the paper to the drum. With a proper corona charge the sheet material tends to flare out in a controlled manner—which assists in the desired detachment of the sheet material from the drum. However if the sheet material has a high print data density and is thus substantially wet, this would tend to bleed off the desired corona charge. It will be understood that the above factors affect the detachment of the paper from the drum. If such detachment takes place at other than an optimum time, this may lead to paper jams and print tearing, or to generally unreliable operation.

SUMMARY OF THE INVENTION

Accordingly, an object of this invention is to control the drying operation as a function of print parameters for efficient energy use and rapid operation of the printing apparatus.

A further object of this invention is to efficiently dry print images by controlling the detachment of sheet material from the drum as print parameters vary.

A printing system having apparatus for drying ink printed on print media. Print parameters are detected relating to the drying of the ink printed on the print media. There is provided means responsive to the detection of the print parameters for controlling the drying where the control is in accordance with the print parameters. Further, in accordance with the invention, the print parameters that are detected include print data density, characteristics of the ink and ambient humidity.

DESCRIPTION OF THE PREFERRED EMBODIMENT

Figure 1:
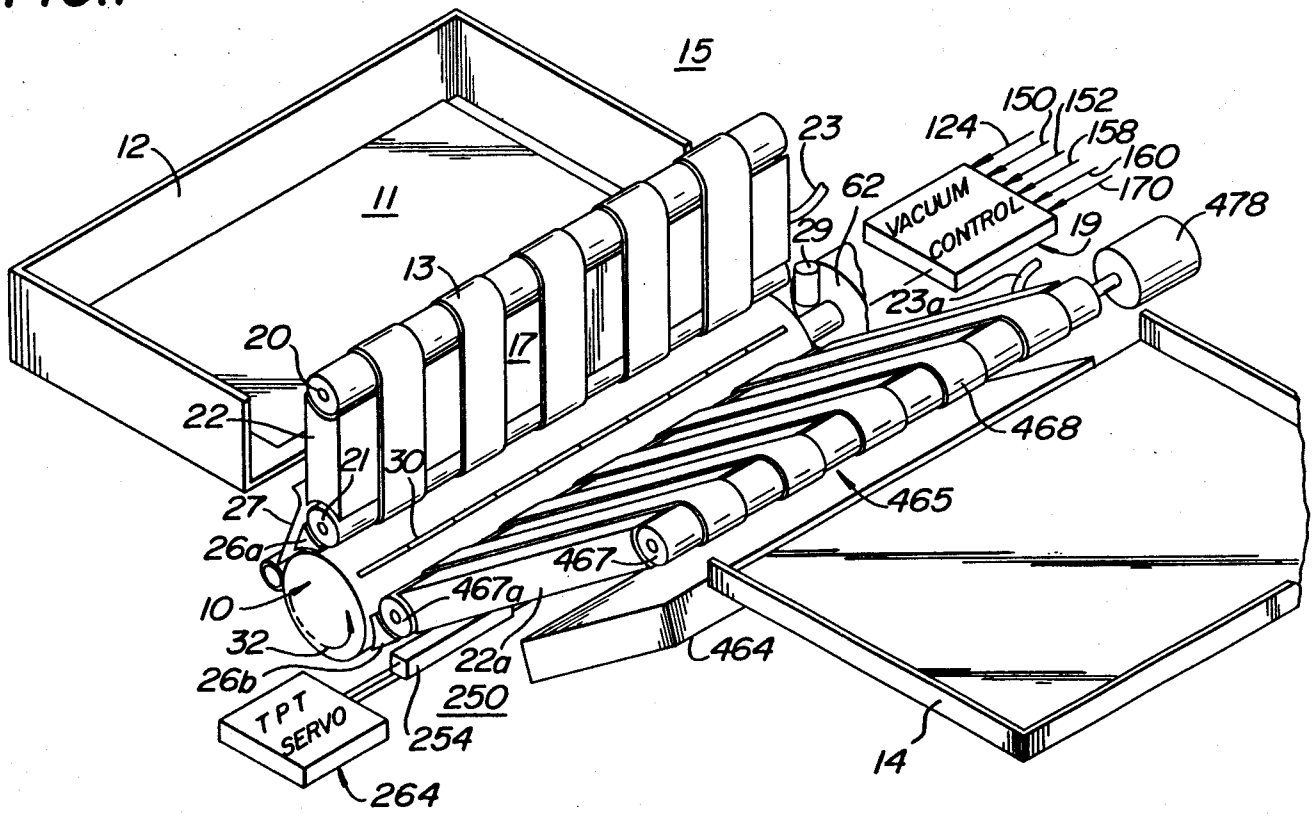
FIG. 1 is a perspective view of a copier system having a drum printer monitoring print parameters and controlling an exit assembly, dryer and detaching apparatus of the present invention.

In FIG. 1, a copier system 15 is shown having a printer with a sheet feed and drum transport assembly 17, an exit assembly 465 and at least one dryer 464. The printer may be of the ink jet type having ink jet nozzles (not shown) carried by an array transport system 250. Copier system 15 provides control and sequencing for (1) sheet feed and drum transport assembly 17, (2) array transport system 250 and (3) exit assembly 465 and dryer 464.

In the control of drying, system 15 provides for detection of various print parameters relating to the drying of the ink printed on sheet material 11. The print parameters that are detected include print data density (FIG. 4), ambient humidity (FIG. 9) and characteristics of the ink (FIG. 10). These detected print parameters are used by system 15 to efficiently control drying of the ink printed on the print media of sheet material. Such drying may be accomplished by one or more of (1) the control of heat energy supplied to a dryer 464, (2) the control of the speed of exit assembly 465, and (3) the control of the number of extra revolutions that sheet material is rotated by drum 10. In addition, the detected print parameters are used by system 15 to control the detaching of sheet material 11 from drum 10 until sheet material 11 has dried to the extent that it is sufficiently stiff for reliable detachment. In this manner the operation of system 15 approaches an optimization of the drying and detaching function with respect to time and energy used by the system.

The ink jet nozzles may be driven by input data from a document-scanning system that includes a scanner and a source organizer to feed a data memory in which the image data is stored before being applied to the ink jet arrays. Such a document-scanning system is described in U.S. Pat. No. 4,069,486, issued Jan. 17, 1978 to S. J. Fox, titled Single Array Ink Jet Printer and assigned to the assignee herein. This patent is incorporated herewith by reference.

Figures 6A, 6B:
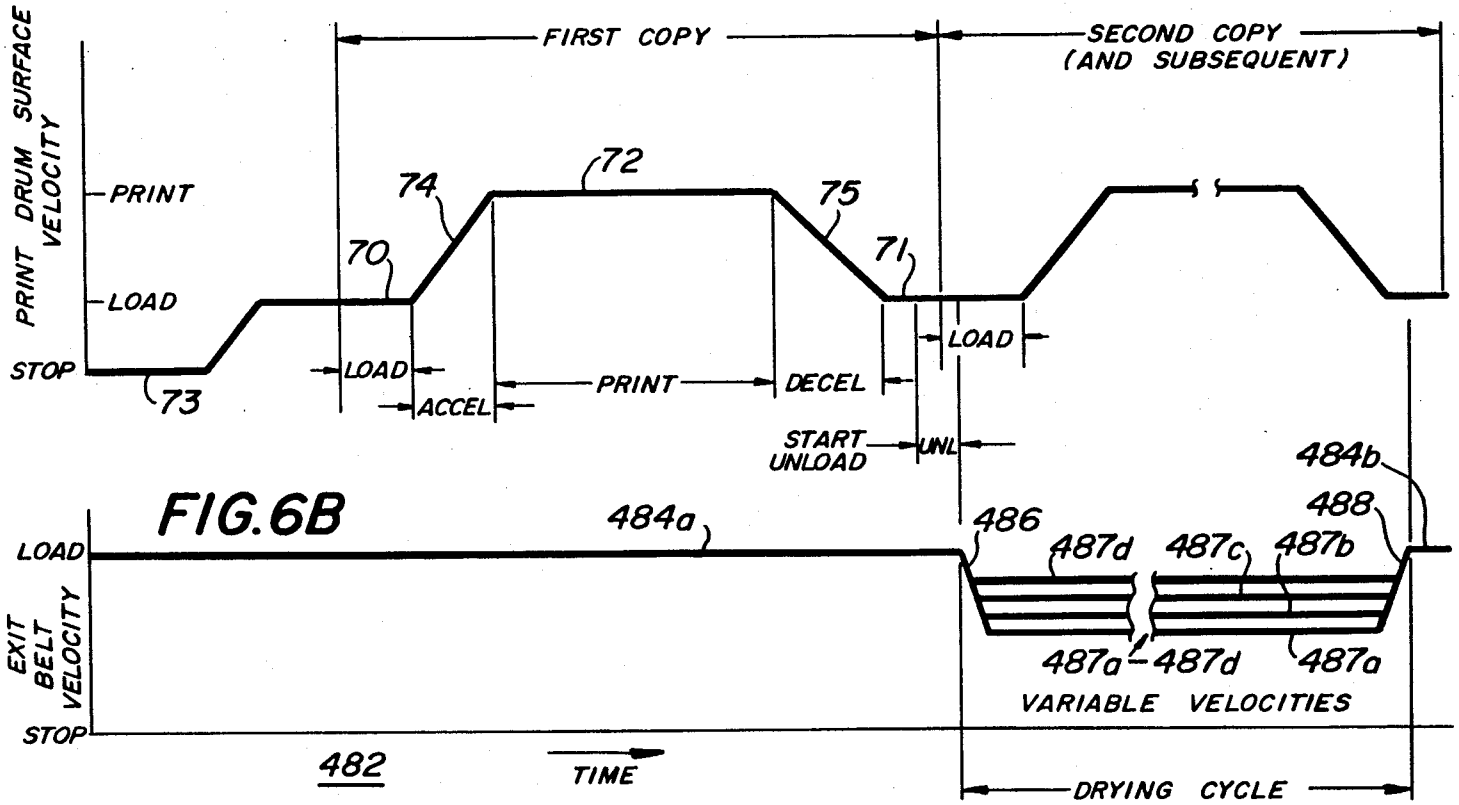
FIG. 6A is a velocity profile of the drum shown in FIGS. 1 and 2.
FIG. 6B is a velocity waveshape of the exit belts shown in FIGS. 1 and 2.

Assembly 17 of copier system 15 has a rotary drum 10 which is fed single flexible sheets 11 from bin 12 by conveying belts 13. Conveying belts 13 are mounted on driving roll 20 and on idle roll 21. A vacuum plenum 22 is provided interior to belts 13, with the plenum connected by way of a conduit 23 to a vacuum source. A solenoid 29 operates a mechanical paper gates of assembly 17 in the sheet path between guides 26 and 27 to prevent any sheet from proceeding to drum 10 until that sheet is released. Drum 10 is driven in a load mode and in a print mode by a drum motor and servo assembly 62. These modes are shown in FIG. 6A, in which the load modes are indicated by segments 70, 71, and the print mode by segment 72. For the purpose of definition herein, segment 71 will be called a load mode even though it actually comprises both an unload and a load mode.

In conventional manner, vacuum control 19 is coupled to drum 10, with conduits to provide both vacuum and pressurized air. Specifically, control 19 is effective to provide leading-edge and trailing-edge vacuum, as well as pressurized air. Vacuum control 19, servo assembly 62 and other details of the sheet feed and drum transport are described in detail in application Ser. No. 919,898 filed June 28, 1978 by E. C. Korte titled Sheet Feed and Transport and assigned to the assignee herein. This application is incorporated by reference herein.

Figure 2:
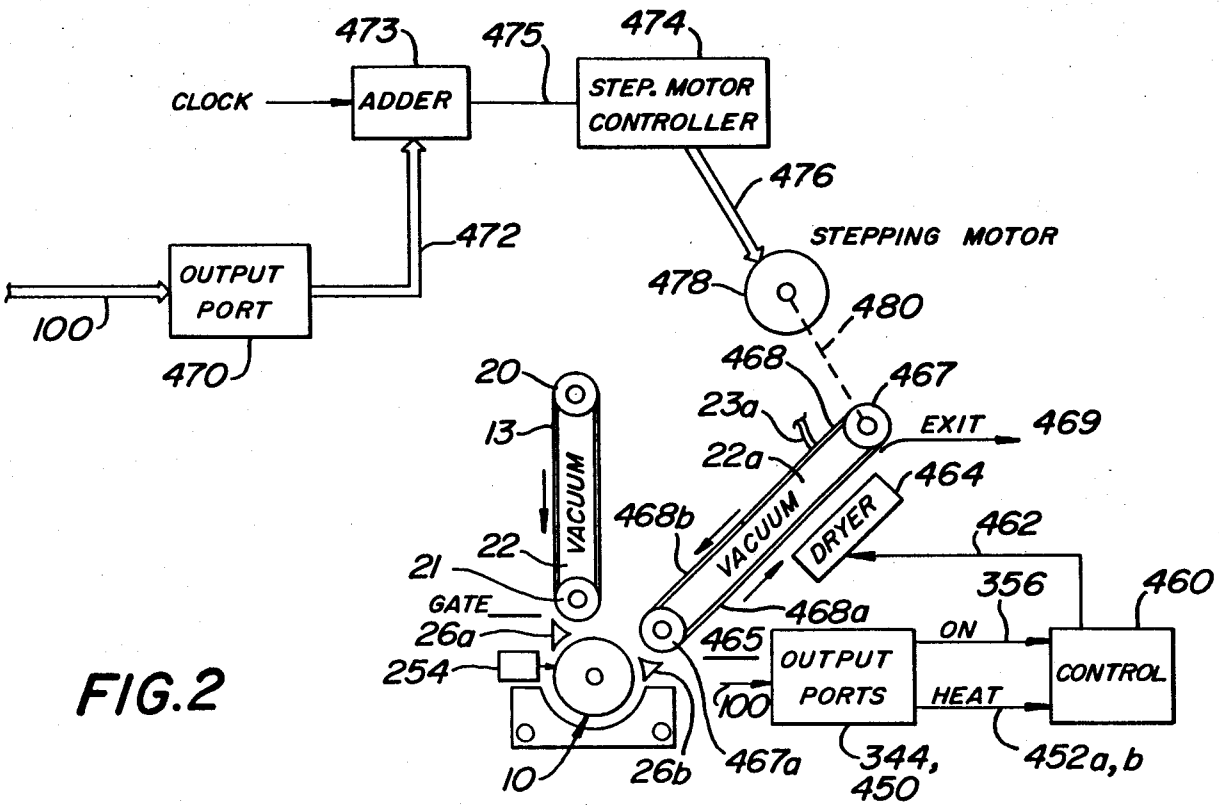
FIG. 2 is a detailed block diagram of the exit assembly and dryer shown in FIG. 1.

After sheet 11 has been printed on drum 10, the sheet is detached onto the lower side 468*a* of variable-speed exit belts 468 of exit assembly 465 as best shown in FIG. 2. Belts 468 are mounted on a driven roll 467 and on an idle roll 467*a*. Roll 467 is driven by a stepping motor 478 which is energized by a conventional stepping motor controller 474. In order to provide a carry or stepping pulse to controller 474 output bus 100 provides control signals through output port 470 and lines 472 to an adder 473 having additionally applied clock pulses. The adder 473 processes the data value on lines 472, and the higher the data value, the more quickly adder 473 provides a stepping pulse on line 475 to controller 474. In this manner exit belts 468 are operated at a desired velocity which may be, for example, one of the velocities 487*a–d* shown in the velocity waveform 482, FIG. 6B.

FIG. 6B further shows the time relationship between the exit belts 468 velocity and the velocity of drum 10 shown in FIG. 6A. Exit belts 468 are maintained at load speed 484*a* during the printing of a first sheet 11 since there is obviously no sheet at that time to be dried. After the first sheet has been printed and for subsequent printings, the velocity of exit belts 468 varies with time as shown by the waveshape formed by deceleration segment 486, a selected one of the variable velocities 487*a–d*, acceleration segment 488, and finally, load speed segment 484*b*.

In operation prior to segment 486, sheet 11 is on drum 10 at load segment 71 and is approaching start unload as shown in FIG. 6A. At this time, exit belts 468 are at load velocity 484*a*. When sheet 11 actually reaches start unload, the sheet begins to detach from drum 10 and to load on belts 468. Thereafter, as shown in FIG. 6B, belts 468 start to decelerate from load speed 484*a* to deceleration segment 486, and at this time, sheet 11 has fully detached from drum 10 and is fully on belts 468. Belts 468 transport sheet 11 so that it passes between dryer 464 and lower belts side 468*a*. Sheet 11 detaches from the belts at exit 469, where it is received in output bin 14. The operation is repeated so that when the leading edge of the next sheet 11 reaches exit belts 468, the belts again attain load speed 484*b*.

Figure 3A:
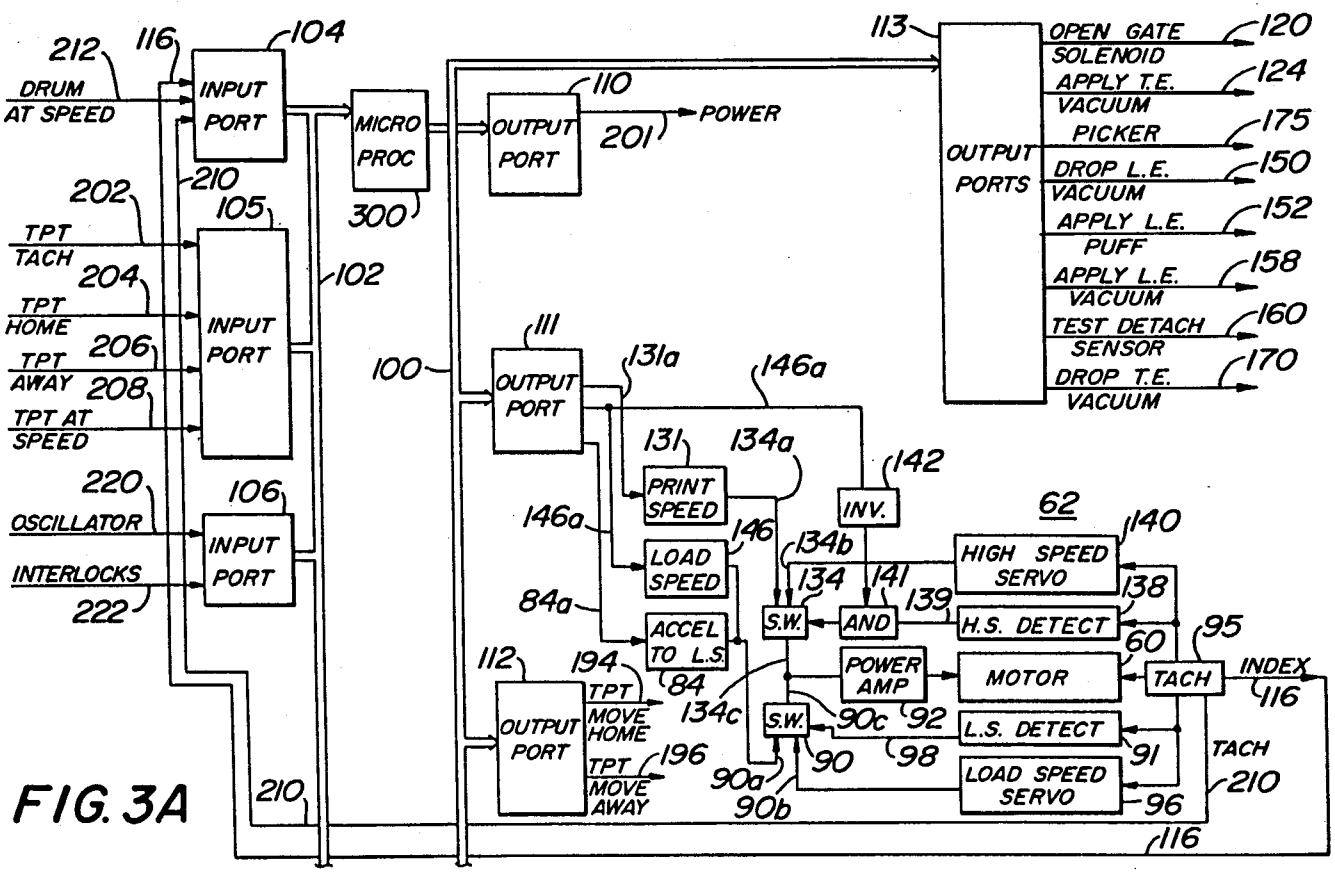
FIGS. 3A–3B taken together form a detailed block diagram of the control and sequencing system for the sheet feed, drum, and array transport shown in FIG. 1.
Figure 3B:
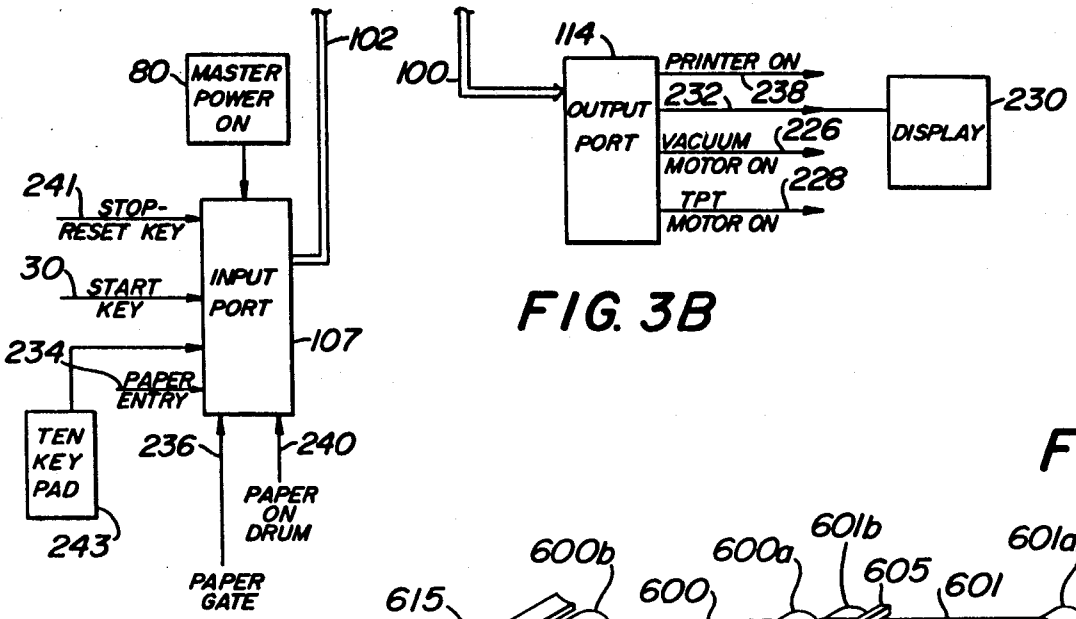

FIGS. 3A–3B show for system 15 most of the details of the control and sequencing system for the sheet feed and drum transport assembly 17 and array transport system 250. As shown, microprocessor 300, which may be programmed by firmware, includes input ports 104–107 and output ports 110–114. Output port 111 supplies signals to the drum motor and servo assembly 62, and this assembly supplies signals to input port 104. Output port 112 provides signals to the TPT servo assembly 264, which in turn provides input signals to input port 105. Selected inputs and outputs of input port 107 and output port 114 are coupled to an operator's panel which includes display 230, tenkey pad 243, start key 30, and stop-reset key 241. The remaining input and output ports are coupled to sheet feed and drum transport assembly 17 and to vacuum control 19, as shown in FIG. 1.

Output port 111 is coupled by way of a line 84*a* to a low-speed acceleration circuit 84. Circuit 84 produces an acceleration waveform to drive motor 60 of assembly 62 from a stop to a load speed. The output from circuit 84 is applied to a switch 90, which is operated by a load-speed detector circuit 91 to a one state. In this one state, the output of circuit 84 is applied by way of switch input 90*a* and output 90*c* through a power amplifier 92 to motor 60. Amplifier 92 is effective to convert the voltage input signal to a drive current. As a result, motor 60 accelerates drum 10 from a stop to a load speed 70, as shown in the waveform of FIG. 6A, in accordance with the signal from circuit 84.

Motor 60 is coupled to a tachometer 95 which provides a tach signal to both a load-speed detector circuit 91 and a load-speed servo circuit 96. Circuit 91 is thus switched into operation when the pulse rate from tachometer 95 is within a specified percentage of the desired load speed. When the pulse rate enters the desired frequency band, circuit 91 is effective to switch circuit 90 from a one state to a two state. When in the two state, switch 90 connects switch input 90*b* to output 90*c*. In the absence of a signal on line 98, switch 90 switches back to its one state. Accordingly, when actuated to the two state, switch 90 applies the output of load-speed servo 96 to power amplifier 92. When drum 10 has reached load speed, the drum at speed line 212 supplies a signal to port 104 of microprocessor 300.

Tachometer 95 is also connected by way of an index output line 116 to input port 104. The input signal on line 116 occurs once per drum revolution and indicates a specific rotational position of drum 10. More frequent pulses are produced by tachometer 95 on tach line 210, which is also applied to input port 104.

Furthermore, a high-speed detector 138 is similar to low speed detector 91, except that it operates at a substantially higher frequency. With motor 60 not at high speed, no signal is applied on line 139 and switch 134 is in the one state. Since switch 134 operates similarly to switch 90, switch 134 connects the output of an accelerate-to-print speed circuit 131 through switch input 134*a* and output 134*c* to power amplifier 92. Accordingly, the amplifier responds to the waveform from circuit 131, thereby driving motor 60 to accelerate from load speed to print speed as shown by segment 74, FIG. 6A. Upon reaching print speed, circuit 138 provides a signal on line 139 through AND gate 141 to actuate switch 134. As a result, switch 134 then connects high-speed servo 140 to amplifier 92. Accordingly, as shown in FIG. 6A, system 15 is brought to print speed 72 and may begin printing a copy.

In deceleration, as shown by segment 74, FIG. 6A, load-speed circuit 146 is effective, through switch 90, to provide a deceleration waveform to amplifier 92. A signal on line 146*a* is effective by way of inverter 142 to block AND gate 141 so that no signal is applied from detector circuit 138 to switch 134. In this manner, motor 60 and drum 10 are decelerated to the load speed. Load-speed detector 91 and load-speed servo 96 then function in the manner previously described to take over the drive of motor 60. The specific inputs and outputs of input ports 104–107 and output ports 110–114 will later be described with respect to the operation of system 15.

Figure 4:
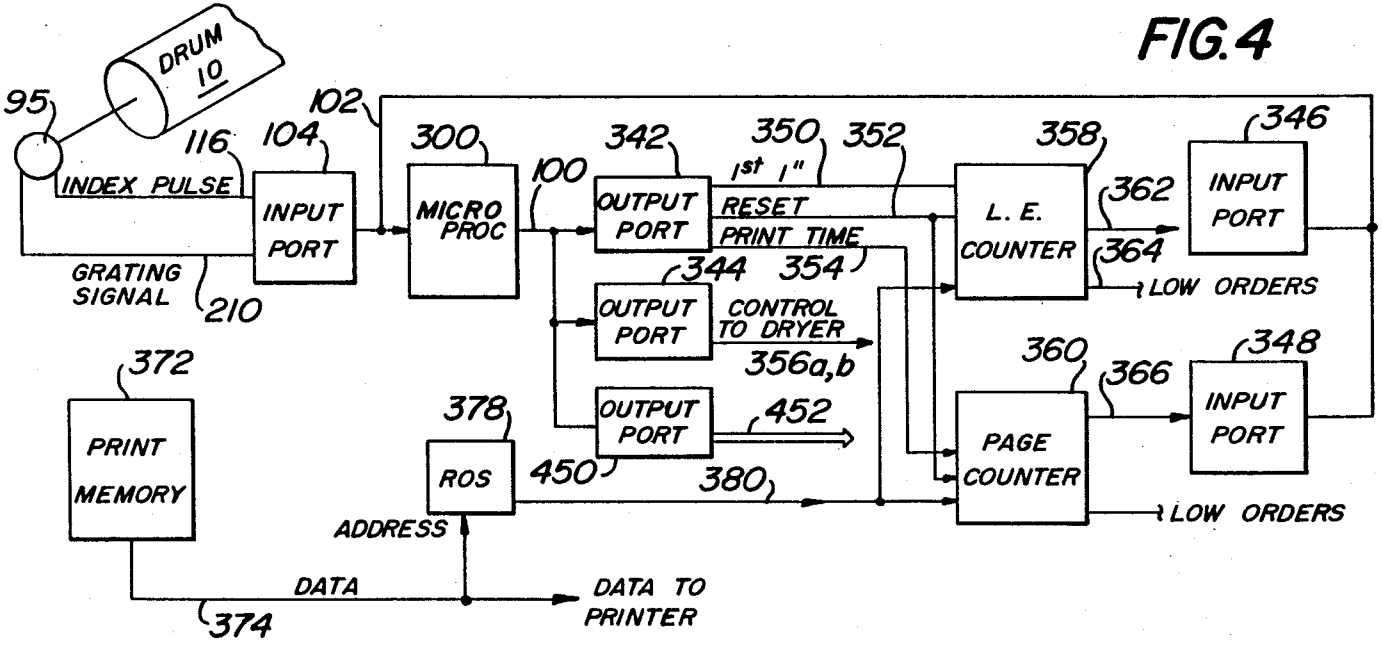
FIG. 4 is a detailed block diagram of systems which control heat energy and detect print data density of the copier system shown in FIG. 1.
Figure 5:
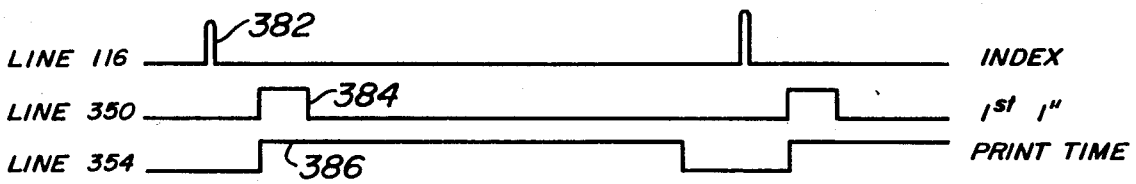
FIG. 5 shows waveshapes helpful in understanding the system for detecting print data density shown in FIG. 4.

FIG. 4 shows in copier system 15 details of the systems which control heat energy and detect print data density. As shown, microprocessor 300 is provided with additional input ports 346, 348 and additional output ports 342, 344 and 450. As in FIG. 3A, FIG. 4 shows tachometer 95 providing a tach or grating signal and an index pulse, which are applied to an input port 104. Output port 342 supplies enabling and reset signals to leading-edge wetness counter 358 and page wetness counter 360, both of which relate to print data density (one of the print parameters). Specifically, port 342 provides on line 350 a first-inch enabling signal 384. FIG. 5, which indicates the time of the leading first inch of sheet 11. This signal is repeated for every revolution of drum 10. Similarly, port 342 provides on line 354 a print-time enabling signal 386, which indicates the total print time for each revolution of drum 10. It will be seen in FIG. 5 that index pulse 382, provided on line 116, occurs just prior to the leading edges of signals 384, 386, which are coincident with the leading edge of sheet 11 as it travels under the print arrays of transport system 250, FIG. 1.

Count signals are also applied to counters 358 and 360 by way of lines 380 from a read only storage or memory ROS 378. Source data for ROS 378 is provided by way of lines 374 from a print memory 372, which is described in the aforementioned U.S. Pat. No. 4,069,486. Print memory 372 also supplies data by way of lines 374 to the remainder of system 15. The data on lines 374 are applied as eightbit parallel address bytes and are a direct indication of the print data density or blackness of the print. In each address, each one bit is considered a black bit, and the ROS sums within each address the number of black bits. In this way the output on line 380 is a direct indication of the count of the black bits and is applied to page counter 360 and leading-edge counter 358. The ouput of counters 358, 360 are applied by way of lines 362, 366, respective input ports 346, 348 and then lines 102 to microprocessor 300.

Figure 7:
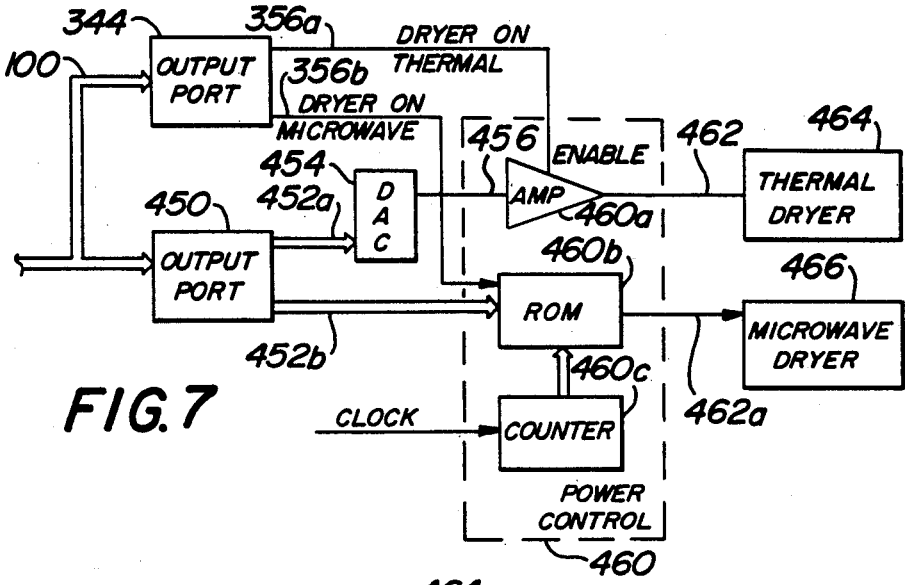
FIG. 7 is a detailed block diagram of the control and driving system for the dryer shown in FIG. 1.

In FIG. 4, output ports 344, 450 provide control and driving signals for dryers 464, 466, as best shown in FIG. 7. Output port 344 provides on lines 356*a*, 356*b* control or gating signals which are applied respectively to power amplifier 460*a* and read only memory (ROM) 460*b*. Line 356*a* provides an enable signal to amplifier 460*a*, which is coupled between output port 450 and thermal dryer 464. Specifically output port 450 provides data on lines 452*a* which data are applied through a digital-to-analog converter (DAC) 454, the analog output of which is applied by way of line 456 to amplifier 460*a*. The analog signal on line 456 is gated through amplifier 460*a* by the enable signal on line 356*a* to produce on line 462 an energizing signal for thermal dryer 464. Dryer 464 may be a conventional hot roll, a hot platen, a lamp, etc., which is thus driven in accordance with control and data related to the print parameters applied by way of output bus 100 through output ports 344, 450.

Instead of, or in addition to dryer 464, a microwave dryer 466 may be provided which is controlled by ROM 460*b*. As previously described, ROM 460*b* receives a control signal by way of line 356*b* from output port 344. In addition output port 450 provides data on lines 452*b* to ROM 460*b* in the form of four address bits. Clock signals are applied by way of a counter 460*c* to ROM 460*b*. ROM 460*b* may be a conventional 256×1 read-only memory in which data stored in the ROM provides a lock-up table to convert a four-bit binary value into a proportional time signal. ROM 460*b* requires eight bits of address, four bits of which are supplied through lines 425*b*. The remaining four bits of address are cycled through by counter 460*c*. In this way "on" line 462*a* is active for a period of time determined by N divided by 16 of the time, where N is the value on lines 452*b*. When line 462*a* is active it energizes dryer 466. In this manner, the active state of microwave dryer 466 may be varied as desired.

Figure 9:
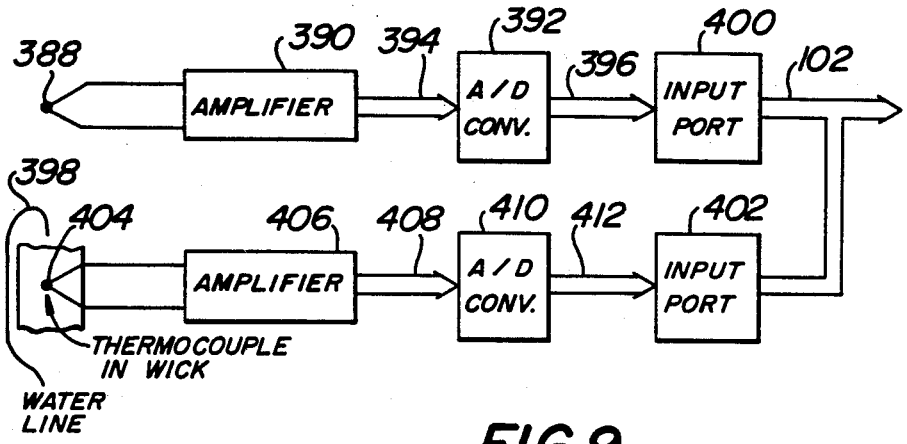
FIG. 9 is a detailed block diagram of a system for detecting ambient humidity to provide signals to input ports of the microprocessor of FIGS. 3A–B and 4.
Figure 10:
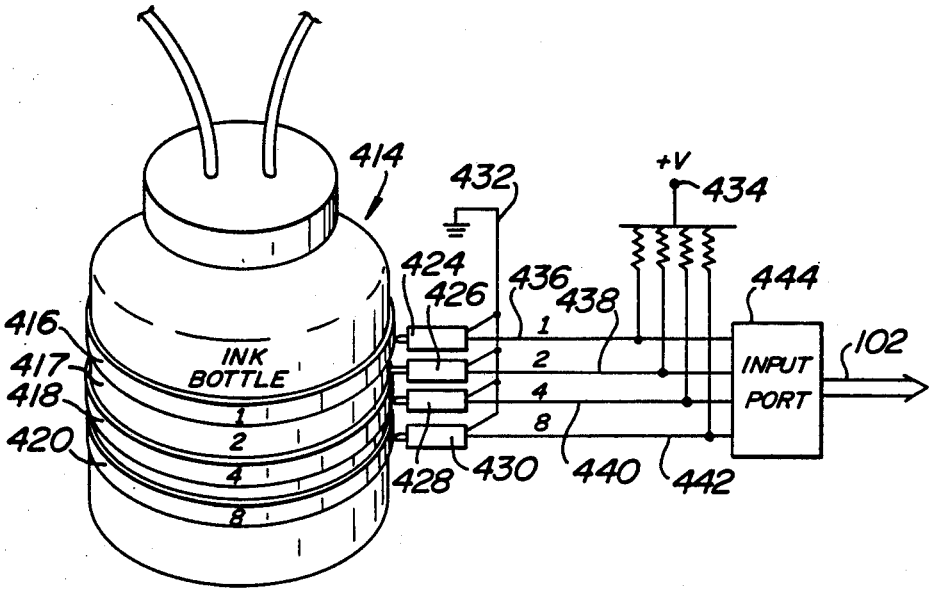
FIG. 10 is a detailed block diagram of a system for detecting ink specifications to provide signals to an input port of the microprocessor of FIGS. 3A–B and 4.

In order to determine the drying effect on sheet 11 as it spins on drum 10, the ambient humidity is detected by dry-bulb detector 388 and wet-bulb detector 404 as shown in FIG. 9. By using ambient humidity as one of the print parameters, system 15 efficiently controls the drying of sheet material 11. Detectors 388 and 404 are coupled by way of amplifiers 390, 406 respectively to analog-to-digital converters 392, 410. The digital signals from converters 392, 410 are applied through input ports 400, 402 to input bus 102 and then to microprocessor 300, FIGS. 3A–3B.

Another print parameter relating to the characteristics of the ink being used is sensed by the circuit of FIG. 10. Specifically an ink bottle 414 is provided having bands 416–418 and 420, any of which are raised or not raised to provide a code to indicate the drying characteristics or specifications of the ink contained in the bottle. Bands 416–418 and 420 correspond to binary weights 1, 2, 4 and 8 respectively. The presence or absence of a ridge on bands 416–418 and 420 is detected by microswitches 424, 426, 428 and 430 respectively which control the potential on weighted lines 436, 438, 440 and 442 respectively. The weighted lines are coupled to input port 444 of microprocessor 300.

In the example shown in FIG. 10, bottle 414 provides drying level information corresponding to the binary value of 13 since the bottle has ridges on bands 416, 418, 420. It will be understood that bottle 414 with associated ridges may be entirely molded of plastic.

The operation of copier system 15 will now be described with respect to the control and sequencing for the sheet feed and drum transport assembly 17, exit assembly 465, dryers 464, 466 and array transport system 250. The listing for the program for microprocessor 300 is attached hereto and is written in a structured format understandable by those of ordinary skill in the art. The operation starts with an initialization sequence. For executing the code, microprocessor 300 may be an I/O processor used with the IBM Series I computer.

INITIALIZE

As set forth in paragraph 5 of the listing, to start system 15, a master power-on switch 80 (FIG. 3B), is actuated and INIT is accessed. The first operation is a reset signal in line 224 applied to POWER ON RESET (POR latch 324, FIG. 11). At this time, a COPY REQUEST flag is also reset. In the next step, turning on the MAIN POWER RELAY brings up line 201 in FIG. 3A. The code drops through another entry, INIT1, paragraph 5.2, which is entered after handling an error, such as a jam. This is the location the code would enter after a jam has been cleared. In the first step or INIT1, a reset signal is produced from output port 344 (FIG. 4) on line 356*a* to turn off thermal dryer 464 (FIG. 2). One reason for turning off thermal dryer 464 is that in the event of an error, with system 15 having to be opened up to take a sheet 11 out, it would be unsafe to have the dryer in a heated state. In the next step, output port 470 (FIG. 2) produces on lines 472 a signal to cause variable-speed motor 478 to run at full speed.

Thereafter all the ERROR FLAGs are reset and the NOT READY LIGHT is turned on; it remains on until system 15 is brought up to usable condition—a procedure that takes some time. Next, the function utility routine reset panel (RSTPNL—paragraph 6.1) is called. This routine brings the operator's panel, (paragraph 4), back to power-on condition. The COPY REQUEST COUNT is set to 1 and applied to display 230 (FIG. 3B).

Thereafter, the PROFILE COMPLETE FLAG is reset. This is a software flag that is turned on after a successful profile of the system is made. This is effective to force the profile routine in paragraph 21 to be run during the initializing phase. Also reset is LOAD ADJUST FLAG, another software flag that will be set when paper 11 has been successfully loaded on drum 10. Meanwhile, a nominal load time of 152 is set into variable CALCLOAD. If the HEAD UP FLAG is off, then a subroutine called INKUP is run. INKUP (paragraph 6.5) brings up all of the pressures in the ink lines and checks all of the levels in the ink system. If this is successful, the HEAD UP FLAG is set, with return to the main program flow.

The initialize routine in paragraph 5 then turns off the NOT READY LIGHT, and the system proceeds to the IDLE routine in paragraph 8 unless the COPY REQUEST flag is on. If this is an error-handling case, the RETRY routine in paragraph 5.3 is executed, and an error light is illuminated in display 230. The operator may then clear the jam, and has has two options. In the first option, he may actuate a RESET KEY which cancels the remaining copy run and causes a return to IDLE, paragraph 8.0. As a second option, the operator may actuate the start key 30 or master power-on switch 80 after clearing the jam; the code at STARTIT, paragraph 9, is then executed. The run is continued, and the required additional number of copies are made, so that the total number is correct.

The IDLE routine, paragraph 8, waits for the operator to request copies from system 15. This is the normal idle state of system 15. As the first step, the COPIES COMPLETE flag is set to zero, and the NO USE TIMER is reset to zero. A DOUNTIL loop is then entered and continued until there is a closure of start key 30 or a closure of reset key 241 or until any ERROR FLAG comes on or COVER INTERLOCK OPEN is set. Ten-key pad 243 is then integrated, which means that the system takes several successive samples for noise rejection. If the samples are the same, then the switch on pad 243 is actually closed. Thereafter, display 230 is updated with anything that has been keyed in. An integration of switches takes place, and if there is any paper in the path anywhere (there should be no paper in system 15 other than in the input bin during IDLE), ERROR FLAG 1 is set. Furthermore, other switches are also integrated, and the normal way out of this routine is STARTIT, paragraph 9.

In the STARTIT routine, paragraph 9, a COPY REQUEST flag is set and remains on until the run is completed successfully. The DONE FLAG is cleared until the last copy is run. As the next step, energizing signals are applied by way of vacuum motor line 226 and transport motor line 228 from output port 114 (FIG. 3B). Digital signals from output port 450 (FIG. 2) are applied by way of lines 452 to DAC 454, which produces a resultant analog signal on line 456. This analog signal is applied to power control 460, which controls thermal dryer 464 to a preheat value so that dryer 464 starts to warm up. In addition, output port 470 produces on lines 472 a load speed signal 484*a*, FIG. 6B, which is effective to set speed control 474, so that belt 468 runs at the same load velocity 484*a* as drum 10, segment 70, FIG. 6A, as shown in FIGS. 1 and 2. Furthermore output port 344 provides a signal on line 356 to gate power control 460 so that the previously generated signal on line 456 is applied by control 460 to dryer 464 to start dryer warmup. If the PROFILE COMPLETE FLAG is off (it will always be off for the first copy of the day), the PROFILE routine, paragraph 21, is called in order to characterize system 15 and to determine the existing running values of the critical parameters during a nonprinting cycle. These actual running values provide a profile and they are stored and used during the subsequent printing cycles.

PROFILING OF DRUM AND TRANSPORT

The PROFILE routine, paragraph 21, calls a subroutine STP2LOAD, paragraph 6.9, to bring drum 10 up to load velocity with a minimum of checking, since this is not a critical part of the cycling. As shown by the waveform of FIG. 6A, velocity at rest is indicated by segment 73, and STP2LOAD routine accelerates drum 10 from this zero velocity segment 73 up to load velocity segment 70. It will be understood that the status here is noncritical, as the routine indicates that TIMER is to be set to 45 milliseconds. TIMER is loaded with a constant representing 45 milliseconds, and there is a countdown once every 125 microseconds which produces a delay of 45 milliseconds. In the next step of the listing, the ACCEL TO LOAD SPEED command in block 84 (FIG. 3A) and the LOAD SPEED command in block 146 to the drum 10 are set; this brings the drum up from segment 73 to segment 70 in FIG. 6. A DOUNTIL loop is then performed until the TIMER counts down by MSTIMER (paragraph 6.2) to zero or until drum 10 applies to input port 104 a DRUM AT SPEED signal by way of line 212, FIG. 3A.

In the MSTIMER routine, paragraph 6.2, every time oscillator line 220 changes there is an update in TIMER function, which is a count in one of the registers in microprocessor 300. If oscillator line 220 has changed, TIMER is updated, and if it has not changed, the program returns to the main program flow. The MSTIMER routine tracks line 220 as long as these calls are not too far apart.

After each call of MSTIMER, the program responds to the value of TIME and the DRUM AT SPEED line 212. Two events can bring the program out of this DOUNTIL loop. The first event is that TIMER reaches zero before drum 10 accelerates to load speed 70, which indicates that there is a defective drum. In that event, ERROR FLAG 2 is set, and an error-handling routine is called. In the second event, the DRUM AT SPEED line 212, FIG. 3A, provides a signal before TIMER equals zero, which indicates that the drum accelerated in a satisfactory manner. In the second event, the program returns to the caller, and the PROFILE routine is returned to. Assuming the second event, in the next step of the PROFILE routine, another routine called check load velocity (CKLDVEL), paragraph 6.11, is called. This routine ensures that, after the drum accelerates from stop segment 73 to load speed 70, FIG. 6A, drum 10 is actually stabilized at segment 70 at an acceptable velocity, so that paper may be loaded.

Accordingly, the program returns to PROFILE, paragraph 21 and sets TIMER to 257 milliseconds. This is a little over one revolution of drum 10 at load velocity 70. If an index pulse is not present on line 116, there is no reference to the position of drum 10. Accordingly, TIMER is set to a value representing little more than the time of one revolution of drum 10, and another DOUNTIL loop is executed until TIMER is at zero or an INDEX FLAG is seen. MSTIMER, paragraph 6.2 is called to count down the TIMER, and GETPULS, paragraph 6.3, is called to track tachometer 95.

IN GETPULS, paragraph 6.3, an INDEX FLAG is first reset, and the signal on tachometer line 210 is received as is INDEX PULSE on line 116 to input port 104. If the INDEX PULSE is on, the INDEX FLAG is set, and then the TACH COUNT is zeroed to prevent accumulated errors. If the INDEX PULSE is not on, then TACHOMETER readings are compared, and if the TACHOMETER reading is the same as the last sample, then the program returns to the caller. If the TACHOMETER reading is different, then TACH COUNT is incremented, and there is a return to the main program. It will be understood that, on the average, GETPULS must be called at least once during each tach pulse so that none of these pulses are missed.

The PROFILE routine calls GETPULS the first time it is going to correct the OLDTACH flag and may make one erroneous count. However, after that, the first time an index is detected on line 116, locking into the correct count occurs, and thereafter the correct count is kept. If the program comes out of the DOUNTIL and TIMER is not zero, then the index is working correctly.

In the next step, LD2PRT (paragraph 6.10) is called. This brings drum 10 up to pring velocity 72 from load velocity 70 through a velocity slope 74 shown in FIG. 6A. It should be noted that this change from segment 70 to 72 is the acceleration, which is a critical parameter of system 15.

In the LD2PRT routine, TIMER had been set at 700 milliseconds as a safety timeout. Accordingly when this routine returns to the main program, whatever is left in TIMER is a measure of how long drum 10 actually took to get up to that speed. This residual of elapsed time is arithmetically converted in the processor 300 and is stored as ACCTIM (accelerate time), which is an existing running value of a critical parameter determined during this nonprinting profile cycle.

To check whether the index pulse on index line 116 is present at high speed, TIMER is set at 33 milliseconds, which is one millisecond more than the time taken for a full revolution of drum 10 at print velocity 72. The routines MSTIMER and GETPULS are called in the manner previously described, and a DOUNTIL loop is performed also in the manner previously described. The results determine whether the index pulse is occurring properly at the desired high speed. Additionally, print velocity CKPRTVEL, paragraph 6.12, is checked. This routine times the interval between two successive index pulses to ensure correct print speed 72, FIG. 6A. CKPRTVEL, paragraph 6.12 and CKLDVEL, paragraph 6.11, operate similarly. As a result of the higher speed, the resolution is not quite the same, so that instead of timing eight tachometer pulses on line 210, the timing is from index to index—which comprises 256 tach pulses.

In the PROFILE routine, the next step involves drum deceleration 75, FIG. 6A. This subroutine determines (1) how long it takes to decelerate and (2) how far along the surface of drum 10 this deceleration takes place. For reasons later to be described, the distance value is preferable to that of time and is accomplished by starting deceleration at the same time as the tachometer indexed on line 116, FIG. 3A. The routine then determines how many revolutions plus how many TACH COUNTS it takes to decelerate drum 10 until the AT SPEED signal on line 212 again occurs, indicating that the drum is at load speed segment 71. These two measurements are important in determining whether there may be an optimal point of deceleration during actual printing. It is desired that deceleration on segment 75 begin at such a time that the end of the segment 75 coincides with the optimum time for paper removal. Specifically this is accomplished by using the index on line 116 as a reference for deceleration segment 75, with the OVERFLOW COUNT (a number in a register in microprocessor 300) set to zero.

A LOAD VELOCITY command, to load speed block 146 of FIG. 3A, is set to decelerate drum 10 down to load velocity 71. TIMER is set to one second, as a safety timeout to prevent hangup. DOUNTIL is looped until the signal on drum at speed line 212 or TIMER is zero. In the DOUNTIL loop, OVERFLOW COUNT tracks the number of drum revolutions (which is the number of indexes 116 that have been seen). In addition, by looking at TACH COUNT, the fractional part of the drum revolution is calculated, so that there is a precise indication of the drum position when the DRUM AT SPEED signal is received. In this manner, at the time of the DRUM AT SPEED signal, the revolutions in the OVERFLOW COUNTER are known, as well as the TACH COUNT, and calculation may now take place.

Accordingly, the actual values of the critical operating parameters PLSTART and PLREVS will now be determined for the profile. PLSTART is the desired place where the deceleration should be started during the print cycle, and PLREVS is the desired number of index pulses that should be seen during the course of the deceleration. To release the paper at the proper point, DRUM AT SPEED should come up 109° from index 116, which is the optimum deceleration. Accordingly, puffer line 152 should be actuated at 80° from index 116 during that last rotation of drum 10. Thus, just before DRUM AT SPEED comes up at 190°, the PUFFER should lift the leading edge of the paper so that it will detach from the drum. It should be noted that 109° actually equals 77 tach pulses. In the calculation of deceleration time, since TIMER started at one second, if one second is substracted from the value at TIMER end and the complement taken, the resultant is the deceleration time (DECTIM).

In the determination of PLSTART and PLREVS, the reference point is effectively determined. The reference point is the point from which deceleration should take place in order to reach load speed at the proper position. It will be understood that after profiling and in using the stored critical parameters, if the print cycle has not reached this reference point, it is important that the cycle continue at the higher print speed until it reaches the reference point—and only then should deceleration take place. This is to be compared with undesirably starting deceleration before the reference point and then rotating at the slower load speed until a proper release point is reached. The preferable operation is performed in the PROFILE routine by considering whether TACH COUNT is greater than 77 or less than 77. If TACH COUNT is greater than 77, then 77 is subtracted from it. Otherwise, the TACH COUNT is subtracted from 77, the result complemented, and one added to the OVERFLOW COUNTER. The result then is stored in PLSTART and the revolutions in PLREVS. In this manner, the point at which to start deceleration in order to optimize printing is now known.

CKLDVEL, paragraph 6.11, is now called to check whether load speed servo 96 functions properly both for segment 71 and for segment 70. Drum profiling has now been completed, and all of the drum critical parameters have now been obtained.

The profiling of transport 254 of array transport system 250, FIG. 1, will now be described. Routine PRO3, paragraph 21.1, may be entered in two ways. In the first way entry is on the initial profile of the day. In the second way, entry occurs when the cabinet of system 15 has been opened or when transport 254 has been moved away from its end stops. Opening the cabinet produces a signal on interlocks line 222, FIG. 3A; moving transport 254 away from the end stops prevents the sensors feed lines TPT home 204 and TPT away 206 from indicating end of travel. During operation, either the opening of the cabinet or the transport being away from the stops is detected in routine STARTIT, paragraph 9, and transport 254 is placed at one edge or the other before printing starts.

In PRO3 the home delay (HDLY) and the away delay (ADLY) are calculated as described in the program listing. HDLY is a critical parameter determined during this nonprinting cycle, the existing running value of which is equal to the time difference between (1) the drum accelerate time to print speed and (2) the time that transport 254 takes to accelerate from the away end stop to the closest edge of the paper.

The six parameters that have now been determined with respect to drum and transport profile may be summarized as follows:

1. HDLY—this is the delay at the home end that starts at the time of command to accelerate drum 10 to print speed and ends with the command for transport 254 to move away.
2. ADLY—this is the delay at the away end that starts at the time of command to accelerate drum 10 to print speed and ends with the command for transport 254 to move away.
3. ACCTIM—this is the time it takes to accelerate drum 10 from load velocity 70 to print velocity 72.
4. DECTIM—this is the time it takes to decelerate drum 10 from print velocity 72 to load velocity 71.
5. PLREVS—this is the number of tachometer index pulses that occur during drum deceleration—which terminates at 109°.

6. PLSTART—this is the TACHOMETER count to start drum deceleration from print velocity 72 to load velocity 71, when the drum reaches 109°.

All of the above are critical operating parameters. A critical operating parameter is defined for purposes herein as a selected one of the many operating parameters of system 15 that determines or is otherwise material to the performance of the system. A profile taken of a critical parameter is defined for purposes herein as a measurement of the actual value of a critical parameter preferably taken (1) during the start of operation (or restart after an error) and (2) during a nonprinting cycle. During such a non-printing cycle, system 15 is fully functional, but sheel 11 is not moved and no ink is applied. It will be understood that only critical parameters are measured during the nonprinting cycle.

The STARTIT routine, paragraph 9, is now entered, and the PROFILE COMPLETE FLAG is first tested. Depending on the manner in which STARTIT has been reached from the program flow as shown in the listing, a profile may or may not be performed in the manner previously described. Thereafter, the routine determines whether the home and away sensors 204*a*, 206*a* are both off—in which case PRO3, paragraph 21.1, is called. RETRY COUNT and COPIES COMPLETE are then set to zero.

The PICK routine, paragraph 10, is now executed to remove paper 11 from input bin 12. It can be seen that the correct paper bin is selected for input of sheets 11. A COCK PICKER command to PAPER PICKER provides a wait of 65 milliseconds until there is a pull back. This command is then dropped, and at that time a finger shoots forward and pushes a single sheet of paper into the feed. After waiting 130 milliseconds, the paper should be under the paper entry sensor line 234, FIG. 3B. If that line is not high, there is a picker failure, which causes the RETRY COUNT to be incremented. This is tried eight times and, if it is still not successful, the ERROR FLAG 4 is set and the routine jumps to ERROR.

If there is paper at ENTRY, then the routine waits 250 milliseconds for paper 11 to move down the path into proximity of paper gate in accordance with the signal on paper gate line 236, which indicates the presence of paper 11. After this 250 milliseconds, GATE SENSOR is checked, and if the GATE SENSOR is off, ERROR FLAG 4 is set, which indicates a jam in the input, since the paper reached the entry but did not reach the gate. If no ERROR FLAGS have been raised, then a sheet is at the gate, ready to be loaded on the drum 10.

The LOAD routine, paragraph 11, follows; in this routine the trailing edge vacuum on line 170, FIGS. 3A–3B, is turned off. These ports are to be closed so that there is additional vacuum on the leading edge of the paper. As the next step, the index of drum 10 is to be located, since the drum has been turning and the index has not been tracked. Accordingly, the DOUNTIL loop is executed, calling GETPULS, paragraph 6.3, until index line 116 applies a signal. In this way, the index is found and TACH C0UNT is initialized.

PAPER LOADING AND FEEDBACK OF PAPER POSITION

In the NEXT routine, paragraph 12, the LOAD ADJUST FLAG is set whenever a successful load has been accomplished. It indicates that the time required for the paper to get to the correct paper position on rotating drum 10 has been determined. If that flag is reset, it indicates that a calculation has not as yet been made. Accordingly, it is necessary to set a tachometer count of 152 (related to a nominal load time) into a TEMP register, which is one of the program registers in microprocessor 300. In conventional copier systems, that load time would be the constant load time for the system. This time is calculated to be an effective safe time in which to open the paper gate of sheet feed and transport assembly 17. This safe time is not necessarily optimum, but is calculated to get the paper safely on drum 10.

On the other hand, if the LOAD ADJUST FLAG is set, the TEMP register is loaded with a calculated load value (CALCLOAD). CALCLOAD is a variable defining a critical parameter that is a predetermined calculated time stored in memory. A wait then ensues until TACH COUNT equals the value loaded in the TEMP register. Until that time of equality, GETPULS is called, which tracks tachometer 95. When that time of equality arrives (TACH COUNT equaling the value in TEMP), a pulse is produced on open-gate solenoid line 120 to open the paper gate in assembly 17, starting paper 11 towards drum 10. The drum continues to be tracked by the next DOUNTIL until TACH COUNT equals 113. Accordingly, GETPULS is called to update the TACH COUNT.

After the DOUNTIL loop is completed, if a sensor in assembly 17 indicates that there is paper on drum 10, sensor line 240 provides no signal, because the paper has not arrived at drum 10. TEMP register is set to the TACH COUNT because, as long as the paper still has not reached the sensor, TEMP is updated with TACH COUNT for every pass through this loop. When the paper arrives at the sensor in assembly 17, the last updated value of the TEMP register remains in that register, which provides an indication of the time paper 11 arrived. This allows the determination of a new CALCLOAD that defines the actual running value of a parameter related to the drum position at the time of paper release. CALCLOAD is now loaded into TEMP2, and CORRECT is set to a desired tach count, which is the count at which the paper should have arrived at the sensor.

If TEMP is less than CORRECT, the paper arrived early, and TEMP2 is added to half the difference between CORRECT (the time it should have arrived at the sensor) and TEMP (the time it actually arrived at the sensor). The difference is halved because the correction is applied in a direction to cause the paper to arrive late. If the arrival is too late, paper 11 will not stick on drum 10, because the vacuum holes of the drum will be uncovered. Only half the error is added in order to scale it so that the correction does not inadvertently become too great, resulting in the vacuum holes remaining uncovered after the paper arrives.

On the other hand, if paper 11 is late at the sensor in assembly 17, CALCLOAD is updated with TEMP2 less the correction factor of TEMP minus CORRECT. That is to say, the paper gate in assembly 17 is opened earlier (by the full amount of the error) in the next loading. If the paper arrives late, it tends to uncover the vacuum holes; it is important to correct this quickly by the full error amount, so that the vacuum holes can be safely covered. In both cases, the corrections are stored as variable CALCLOAD.

After these calculations, the LOAD ADJUST FLAG is set, since the time to open the paper gate has now been adjusted. It will be understood that the foregoing adjustment of the paper arrival time is accomplished at load time. It is not done during profiling, since it is not desired that paper actually be moved through system 15 during profiling and into output bin 14. Thus, paper is not moved during the profile process; instead this self-adjustment feature for the paper operates during the first copy cycle, i.e., the first time paper is moved through system 15. In this manner, a feedback adjustment of the paper position is provided during the actual copying process, rather than prior to the actual copying process.

The trailing edge vacuum solenoid line 170 is then dropped, causing vacuum to be directed to the trailing edge, so that it tacks down paper 11 when the paper reaches that point. Furthermore, the gate solenoid line 120 is also dropped, and a PRINT SPEED command to block 131 may be set so that drum 10 accelerates up to PRINT SPEED.

PRINTING AND DETERMINING PRINT PARAMETERS FOR DRYING

Thereafter a signal related to the value DV is produced at port 470 and applied through lines 472 to speed control 474 thereby to control the speed of the exit belts 468. DV is a variable in memory that has previously been set to load speed for a first copy 11. In the case of a first copy 11, load speed or nominal speed is maintained, and exit belts 468 are not slowed. The reason for this is that there is no exiting copy loaded onto drying belts 468. For multiple copies, DV will be set to the proper drying speed. In this case, the reason is that the first sheet has already been printed and has exited drum 10 onto belts 468. As it exits on belts 468 the belts are at load speed 484*a*, FIG. 6B. The belts 468 can then be changed in velocity in accordance with speeds 487*a–d*, FIG. 6B while the second sheet is being printed. It will be understood that this operation continues for the N'th copy.

Since PRINT SPEED has been set, drum 10 is accelerating and the LOAD1 routine, paragraph 12.1, is now executed. It will be understood that, with drum 10 accelerating, the profile parameter HDLY or ADLY is now used to determine when to start the movement of transport 254. As previously described, drum 10 always takes longer to get to speed than moving transport 254 takes to get to the edge of the paper. It is necessary to have a delay before transport 254 starts, so that it does not get to the edge of paper 11 too quickly. Accordingly, TIMER is loaded with an interval between startup of drum 10 to PRINT SPEED and startup of transport 254 from stops 290, 292, so that the drum reaches print velocity just before the transport reaches the edge of the paper. This is accomplished by TIMER with HDLY, if the transport is on the home end, or ADLY if the transport is at the away end.

The system now executes the accelerate routine, ACCEL, paragraph 13. A DOUNTIL loop is executed until TIMER equals zero. In the timing loop previously described, GETPULS, paragraph 6.3, continues to track drum 10, and MSTIMER, paragraph 6.2, continues to track oscillator line 220. At the time at which COUNTER is fully counted down, transport 254 is at rest and may now begin its acceleration. Home sensor 204*a* energized indicates that transport 254 is at the home end against home stop 290, and segment 284*a* of velocity curve 285 is applicable. On the other hand, away sensor 206*a* energized indicates that transport 254 is at the away end against away stop 292, and velocity segment 284*e* is applicable. As a result of the foregoing signals (and depending upon the position of transport 254), a signal is supplied from output port 112 and applied by way of move home line 194 or move away line 196, as applicable.

Thereafter, TIMER is set to 250 milliseconds, which is a safety delay to ensure against system errors or malfunctions. Another DOUNTIL loop is then executed until a sensor 204*a* or 206*a* turns off, as indicated by falling edges 280*a*, 282*a*, respectively, or in the case of a malfunction until TIMER is counted down to zero. If TIMER counted down, then ERROR FLAG 5 is set and the system jumps to ERROR, because start of print has not been reached within an allowable time. If TIMER had not counted to zero, drum 10 is up to speed as previously described, transport 254 is at the edge of paper 11, and system 15 is ready to print. It will be noted that the system detects whether paper 11 has fallen off the drum 10 during drum acceleration 74, FIG. 6A. Specifically, the paper on drum 10 is checked by way of a photosensor signal on a paper on drum line 240 from sheet feed and transport assembly 17. Line 240 is coupled to input port 107. If paper 11 is still on drum 10, then the PRINT routine, paragraph 14, is called, or else an ERROR FLAG 4 is set, which indicates loss of paper, and system 15 jumps to ERROR.

In the PRINT routine, if drum-at-speed line 212 from assembly 62, FIG. 1, is not on, then an ERROR FLAG 6 is set, which indicates that drum 10 did not get up to speed in time, and the system jumps to ERROR. If the system does not jump to ERROR, the RSTWET is called, paragraph 6.15, and as shown in flowchart, FIG. 12. This subroutine initializes the wetness counters and computes the drying constants Ks and Kd. This subroutine is thus effective to initialize wetness sensing before each cycle of printing. In the first step, as shown by clock 502, FIG. 12, both counters P and L 360, 358, FIG. 4 are reset by a pulse produced on line 352 from output port 342. In addition counters within processor 300 dedicated to leading edge wetness (LEW) and page wetness (PGW) are initialized to zero as shown by blocks 504 and 506, FIG. 12. A subroutine LOADKK is called, paragraph 7, which is shown in the flowchart as block 508, FIG. 12.

This subroutine takes the code from ink bottle 414, FIG. 10, through input port 444, which indicates the drying characteristics of the ink being used, and this code is set into temporary register TEMPA. The numeric value of TEMPA represents an ink drying time from ink application until moisture content drops below a predetermined threshold. In addition to the value of the dry bulb temperature from sensor 388 and the value of the wet-bulb temperature from sensor 404, FIG. 9, provide respective signals through ports 400, 402 that are stored in temporary registers TEMPQ and TEMPR, respectively. Using these temperature values, the relative humdiity is found through well-known tables associated with sling psychrometers. The output of this table lookup is placed in TEMPB. All of these parameters are used to calculate a proper drying constant Kd, which may vary for differing inks and for differing ambient humidity conditions. As described in paragraph 7, the ink drying constant (TEMPA) is multiplied by the relative humidity (TEMPB) and is scaled by factor KX. The resultant value is then divided by the temperature, which is effective to produce a constant Kd that reduces the wetness counts, LEW, PGW, by the estimated drying produced by one drum revolution.

Specifically, Kd will be less than one and will indicate the amount of print drying on a single revolution of drum 10.

The drying constant Ks is related to the amount of drying that occurs during deceleration. The number of revolutions of drum 10 is found by dividing DECTIM, which was obtained during profiling, by the period of drum rotation at print velocity. The resultant number of revolutions is then multiplied by Kd to produce Ks. This value of Ks is used to predict how much drying should occur during this period of slowdown before sheet 11 exits from drum 10.

Figure 12:
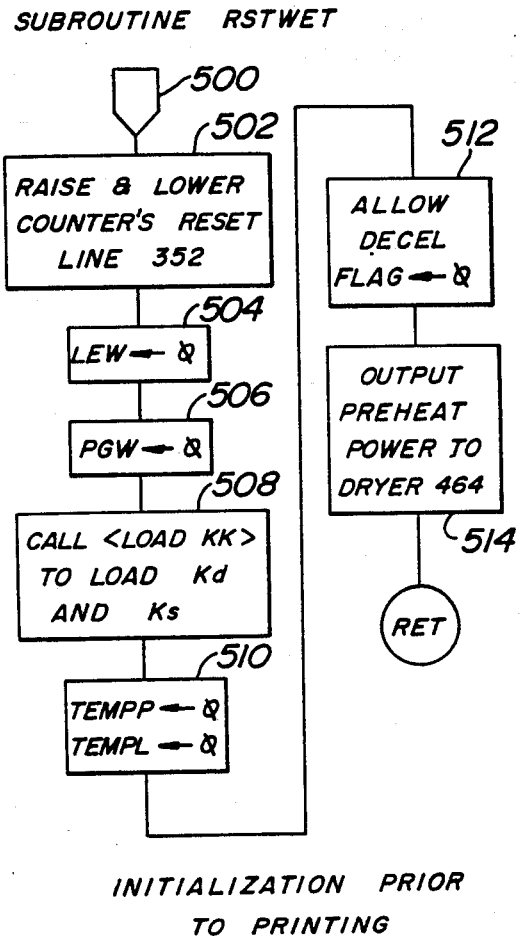
FIGS. 12–16 are flow charts helpful in understanding portions of the program for the microprocessor particularly directed to the operation of exit assembly 465, dryers 464, 466 and to the detection of print parameters.
Figure 13:
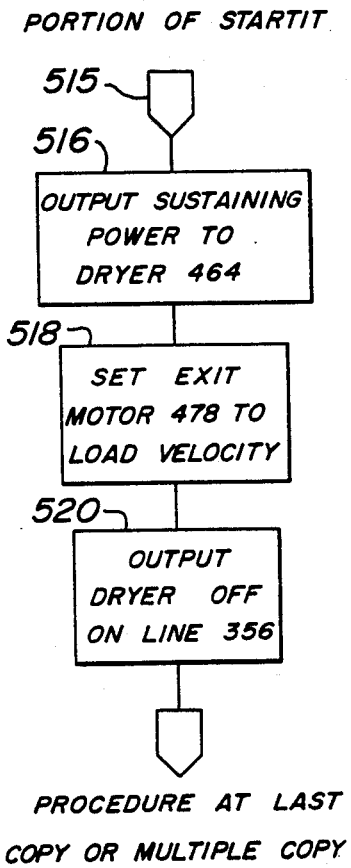

After execution of the subroutine LOADKK, the temporary work registers, TEMPP and TEMPL, which are to be used in the calculation of page wetness (PGW) and leading edge wetness (LEW), are set to zero, as shown in block 510, FIG. 12. The ALLOW DECEL FLAG is reset, block 512, FIG. 12, which indicates that deceleration is now allowed until sheet 11 has been dried sufficiently to ensure that it detaches properly from drum 10. The thermal dryer is set to preheat power by way of port 450, lines 452, DAC 454 and power control 460, FIG. 7, as shown by block 514, FIG. 12.

After execution of subroutine RSTWET, everything has been reset or initialized, the required drying constant Kd has been computed (using the print parameters, relative humidity and the type ink within bottle 414), and the program returns to the print routine. Accordingly, a signal is produced from output port 114 that is applied by way of printer on line 238 to ungutter the ink spray head on transport 254, to permit printing to begin. REVOLUTION COUNTER is now set to zero, and system 15 requires 224 revolutions of drum 10 to print an entire sheet of paper 11. These revolutions are tracked in the next DOUNTIL loop. At this point, a COUNT routine, paragraph 6.13, is called, to increment a count of COPIES COMPLETE that was earier zeroed. When COPIES COMPLETE equals COPIER REQUESTED, a DONE FLAG is set, so that no more sheets of paper 11 are fed. It will be understood that a revolution counter is included in the registers of microprocessor 300 and used as a microcoded counter register.

Figure 16:
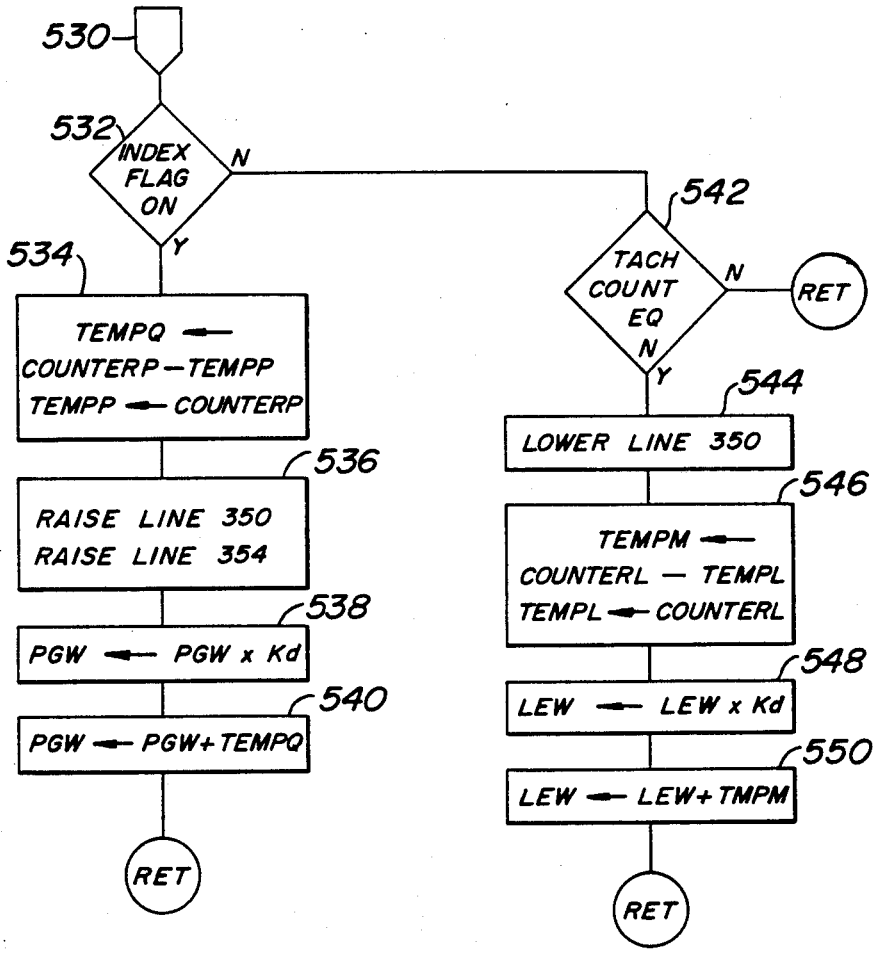

System 15 then returns to PRINT routine, paragraph 14, and TIMER is set to eight seconds. This is a safety time-out to provide for a system error or malfunction caused by transport 254 not arriving at the opposite end of sheet 11. The previously described DOUNTIL loop is performed until 224 revolutions are reached, at which time GETPULS, paragraph 6.3, is called and then (sequentially) MSTIMER, paragraph 6.2, is called with the loop. In addition the subroutine GETWET, paragraph 17.1, is also called. This GETWET subroutine is shown in flowchart FIG. 16 and is used to accumulate the wetness counts by summing the wetness data every rotation of drum 10 during printing. The INDEX FLAG is tested in decision diamond 532 to determine whether a full page revolution of drum 10 has been accomplished, as determined by a signal on line 116 from tachometer 95, FIG. 3A. If a full drum revolution has been made, the INDEX FLAG has been set by index pulse 382, FIG. 5 on line 116, and block 534 is entered. The contents of page counter 360, which contains the current wet count, is applied by way of lines 366 through input port 348 and is stored in register TEMPQ. On the prior pass through GETWET, TEMPP was set with the previous wetness count. Accordingly, the amount of wetness that is accumulated on the drum in the last revolution of drum 10 is the value of the present wetness count TEMPQ sinus the value of the previous wetness count TEMPP. This difference value is saved as a new value of TEMPQ. Register TEMPP is set with the new wetness count, thereby initializing it for the next calculation. After register TEMPP has been initialized, as shown in FIGS. 4 and 5, signal 384 is applied from output port 342 by way of line 350 to counter 358. The leading edge of this signal is effective to enable counter 358. Similarly output port 342, by way of line 354, provides signal 386 to page counter 360. The leading edge of signal 386 is effective to enable counter 360. It will be understood that the estimated page wetness has previously been set into register PGW, and this estimated page wetness is multiplied by the drying factor KD. In this manner there is an adjustment of the accumulated page wetness for the amount of drying that is occuring during each revolution of drum 10, as shown in block 538, FIG. 16. In block 540 the incremental wetness of register TEMPQ is added to the page wetness, and this new reading is returned to the caller.

If the GETWET routine, paragraph 17.1 is entered and the INDEX FLAG is off, there is a jump from decision diamond 532 to decision diamond 542, which starts the GETLE subroutine, paragraph 18.1. If TACH COUNTER, the count of the grating signal on line 210, is not equal to 25 then there is a return to the caller. If TACH COUNTER is equal to 25 then blocks, 544, 548 and 550 and executed. As previously described, counter 358 had been enabled. In block 544 the trailing edge of pulse 384 is effective by way of line 350 to disable counter 358, indicating that sheet 11 is past its leading edge. Blocks 546, 548 and 550 are similar to the steps of blocks 534, 538 and 540, respectively, and thus an adjustment in the accumulated count of leading edge wetness is made during the latest revolution. This new reading is set in register LEW, and there is a return to the caller.

If INDEX FLAG is set when the program returns from GETPULS, the REVOLUTION COUNTER is incremented by each index pulse produced on line 116. At every ten counts of REVOLUTION COUNTER, a series of checks are made. This is done by a case statement which states that if a case is met, the listed action will be performed. Accordingly, at every ten counts of the REVOLUTION COUNTER, the reset switch line 241, which is coupled to input port 106, and the interlocks line 222, which is coupled to input port 106, are examined. For example, if line 241 indicates that a reset switch has been actuated, a DONE FLAG is turned on, so that the copy being printed is the last one. If a cover interlock has been opened, ERROR FLAG 7 is set, and the program goes to ERROR to shut system 15 down. In similar manner, other checks are made and other actions are executed when the REVOLUTION COUNTER equals 1, 11, 21, 31, 206, 208, 212, 220 and 221, as set forth in the program.

CONTROL OF DRYING AND DETACH

When the REVOLUTION COUNTER equals 220, sheet 11 as shown in FIG. 1, should be past dryer 464, which in this embodiment may be a microwave dryer 466, so that the dryer may be turned off. This is accomplished by a reset signal produced by output port 344, FIG. 4, by way of line **356*b* to power control 460. In the embodiment of FIG. 2, it is desired that belts 468 be at load velocity 484***b* (FIG. 6B) at detach time, so that sheet 11 may be unloaded onto belts 468 at that time. Accordingly, port 470 produces a signal on lines 472 to control speed control 474 to bring belts 468 up to the required load velocity 484*b*. In system 15 of FIG. 1, when using a thermal dryer 464, it is only necessary that, after sheet 11 has passed the dryer, the dryer be maintained in its warm state. Accordingly, in FIG. 7, port 450 produces a signal on lines 452 through DAC 454 to power control 460 to maintain thermal dryer 464 in its warm state.

When the REVOLUTION COUNTER reaches 224, the printer-on command is reset, dropping the sign on line 238 from output port 114. Accordingly, the heads of transport 254 are guttered when printing is completed, and the system calls a SLOWUP routine, paragraph 15.

The SLOWUP routine is now entered to stop transport 254 and to decelerate drum 10. This routine uses two variables of the profile, specifically PLREVS and PLSTART. As previously described, PLREVS is the number of index pulses during drum deceleration—which was set to end at 109°. PLSTART is the number of tachometer output pulses required to start decelerating from print to load velocity. Accordingly, PLREVS is loaded into COUNT, and PLSTART is loaded into COMPARE. A DOUNTIL loop is performed until (1) TACH COUNT equals PLSTART, (2) either TPT home sensor or TPT away sensor is up, and (3) ALLOW DECEL FLAG is on. Previously in the RSTWET routine, paragraph 6.15, the ALLOW DECEL FLAG has been reset, and thus the DONTIL loop is executed at least once. System 15 waits for the following three events to occur: (1) for the array transport 250 to reach either home or away end so that deceleration of the transport may begin, (2) for the correct count of tach line 210, FIGS. 3A–3B, so that deceleration of drum 10 may be started, and (3) for sheet 11 to dry enough for the ALLOW DECEL FLAG to be set. Accordingly, a GETPULS routine, paragraph 6.3, is called to increment TACH COUNT until all three of these events occur.

Figure 15:
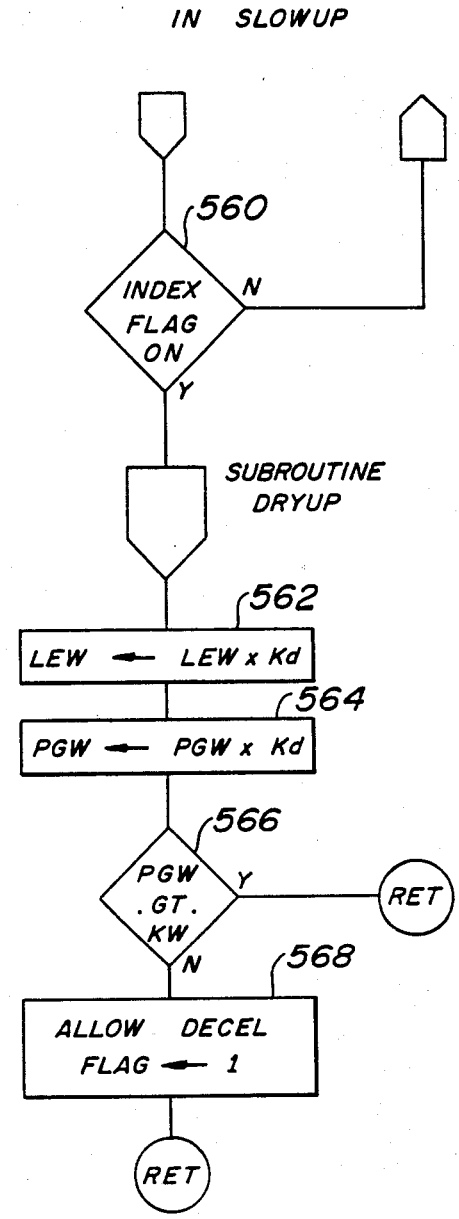

If TACH COUNT equals COMPARE (PLSTART having been loaded into COMPARE) and ALLOW DECEL FLAG is on, then system 15 sets the LOAD SPEED command in block 146, FIG. 3A, to drum 10. From the profiling, this is the time that has been determined as optimum for beginning of deceleration. Thereafter, if INDEX FLAG (set from index line 116) in on, there is a decrement in COUNT, and subroutine DRYUP, paragraph 19.1, is called. Subroutine DRYUP tracks the wetness while waiting for deceleration of drum 10 to occur. As shown in FIG. 15, during a wait for deceleration the leading edge wetness and the page wetness are multiplied by the drying constant Kd in blocks 562, 564, so that the resultant LEW and PGW constantly decrease in value. A test is made in decision diamond 566 of page wetness versus maximum wetness Kw allowed for permitting the paper to exit through the paper path. If PGW is greater than Kw there is a return to the caller. If not, then in block 568 the ALLOW DECEL FLAG is set. The DRYUP subroutine is used for a very wet sheet 11, so that this sheet is maintined on the drum for a number of extra rotations which allow it to be handled and exited to the paper path. It will be understood that, in the case of a substantially ink-saturated (black) sheet, the sheet is limp and soggy and should not be passed through the paper path in that condition. The number of revolutions on drum 10 that the sheet is subjected to is dependent on counting down PGW until it is less than a predetermined value Kw. After all of the above, three DOUNTIL conditional events occur, the system comes out of END DOUNTIL, and both transport 250 and drum 10 are decelerating.

The next DOUNTIL calls GETPULS, paragraph 6.3, and at each index pulse on line 116, COUNT is decremented. At the END DOUNTIL, the COUNT is at zero and drum 10 is on the last revolution. At this last revolution, it is desired to puff paper 11. Accordingly, a turn-off signal is applied to leading edge vacuum line 150 from output port 113, FIG. 3A.

Figure 14:
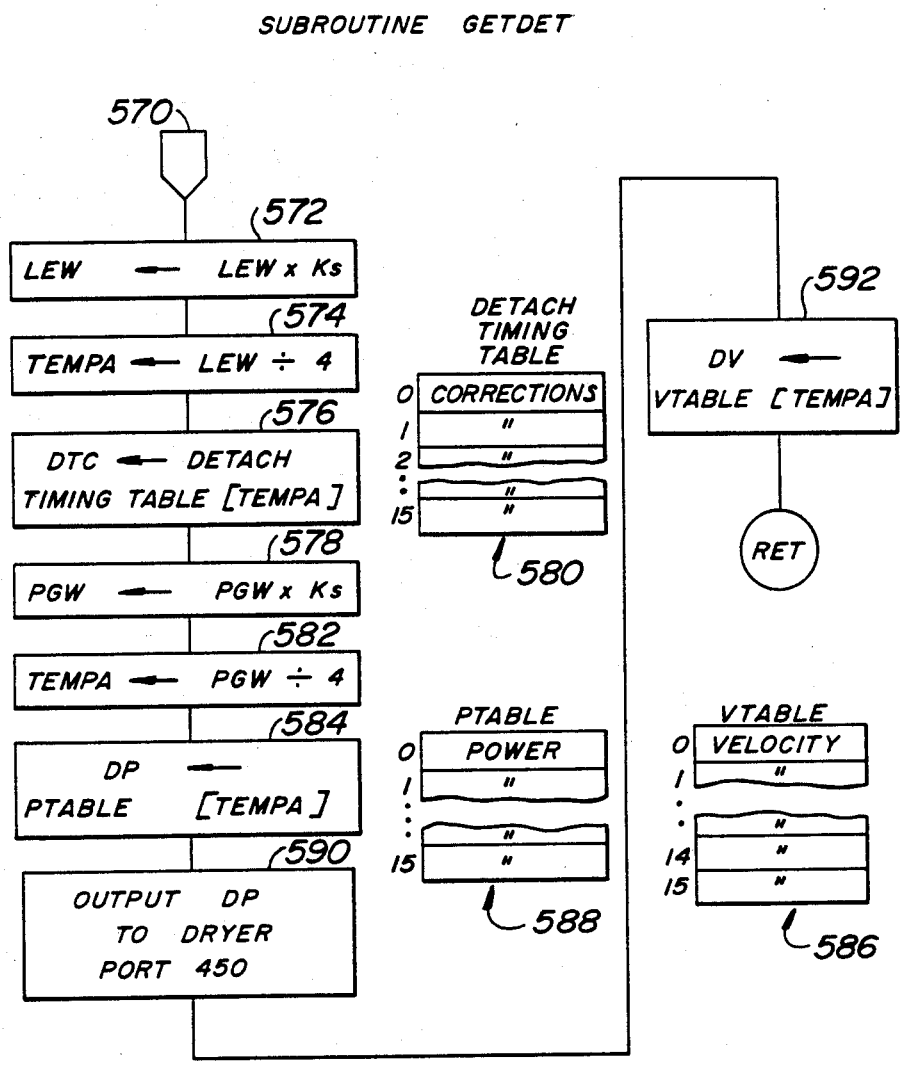

The GETDET subroutine, paragraph 20, is called to determine the wetness of the leading edge of sheet 11, since the leading edge may have dried to some degree in the previous subroutine DRYUP. As shown in FIG. 14, a series of table look-ups are provided, to correct the detach time in relation to beam strength and corona. These consist of a power table (PTABLE), a velocity table (VTABLE), and a detach timing table. In block 572, as drum 10 slows down in deceleration, LEW is modified by multiplying its value by Ks, which provides the scale for slowdown time. LEW is rounded to its most significant four binary places in block 574, and a table look-up is performed in block 576, using LEW as an index into the detach timing table 580. Depending on the value of LEW, a value is found that determines the tachometer count for start of detach. As shown in block 576 this value is stored as the detach count DTC. The overall page wetness is then scaled for the slowdown in block 578. Specifically, PGW is multiplied by Ks to scale overall page wetness and is rounded to proper length for table indexing. A table look-up is then made in block 584 in which the rounded PGW is used as an index to determine a value of dryer power from table 588. This value of dryer power is set into register DP and is applied from port 450 through lines 452, DAC 454 and line 456 to power control 460, FIG. 7. If a thermal dryer 464 is used, the control 460 is effective to begin to increase thermal dryer power to the proper drying level. On the other hand, if a microwave dryer 466 is used, it is not yet turned on.

In block 592 a table look-up is made, using PGW as an index in VTABLE 586. The resultant velocity value is stored in register DV and will be used later for controlling belts 468 in FIG. 2. A return to the caller is then made.

When TACH COUNT equals DTC, which is the detach count related to detach time, then leading-edge puff line 152 is brought up. This signal is maintained until drum at speed line 212 goes up, which occurs at approximately 109° of revolution of drum 10. It will be understood that it may not be exactly 109°, depending upon the accuracy of the calculations and upon whether system 15 is changing with time. GETPULS, paragraph 6.3, is called until the drum at speed signal occurs on line 212.

At this point in the program, there is enough data available from system 15 to permit a recalculation of PLREVS and PLSTART, which are the profiling variables involved in deceleration. Accordingly, RECALC routine, paragraph 15.1, is executed when drum at speed line 212 comes up. The data in TACH COUNT (the count at which the signal occurred on drum at speed line 212) is set into NOW. Line 212 should have come up at 109°, if nothing in system 15 had changed with time and if everything had been correctly calculated. Accordingly, if TACH COUNT equals 109°, no further calculations are performed. If NOW is greater than 77, this indicates that drum 10 has arrived late at load speed, and routine LATE is called, paragraph 15.2. In this routine, there is a slight change in parameters to perform a feedback function.

On the other hand, if NOW is less than 77, routine EARLY, paragraph 15.3, is called. After these calculations, a DONE FLAG is checked and, if it is set, the system calls LASTOUT, paragraph 6, which indicates that the last copy of paper 11 has been run, and the copy is tracked to output bin 14. System 15 returns to IDLE routine, paragraph 8. If the DONE FLAG is not set, system 15 goes to the NEXT routine, paragraph 12, which loads the next sheet 11 on drum 10 for a multiple-copy run.

The LATE routine, paragraph 15.2, indicates that drum 10 did not reach speed quite soon enough. Accordingly, PLSTART and PLREVS are loaded so that they can be adjusted. It will be understood that arriving late is more critical than arriving early, since a late arrival may cause difficulty with the detachment of sheet 11. On the other hand, an early arrival means that the time to detach the sheet is lengthened. Thus, in the LATE routine, the entire error is subtracted from PLSTART and PLREVS. A new PLSTART is calculated, and if a borrow is required, PLREVS is decremented. Following these calculations, parameters PLREVS and PLSTART are stored.

Since an early arrival only subtracts from the performance of system 15 and is not at critical as a late arrival, the computation in the EARLY routine, paragraph 15.3, is the same as in the LATE routine, except that only half the error is used as feedback. The reason for this slow rate of change in adding time is to avoid the possibility of an undesirable late arrival.

It will be understood that the recalculation is only with respect to drum 10, and there is no recalculation with respect to transport 254. Since transport 254 is coming to a stop, this condition is noncritical, because it does not take as long to decelerate transport 254 as it does to decelerate drum 10. The transport stop time is for the information of the service man and is not used in the operation of the machine. As long as such stop time is within operating tolerance, it does not affect the performance of system 15.

CONTINUATION OF PRINTING AND EXIT BELT CONTROL

If it is assumed that the sheet 11 just printed was the last (the required number of copies are complete or the reset key 241 has been actuated), LASTOUT routine, paragraph 16, is performed. A time of 370 milliseconds is required for sheet 11 to be detached from drum 10.

In the first step of this routine, port 470 provides a DV output by way of lines 472 to speed control 474 thereby to control speed of motor 478. In accordance with the value of DV, exit belts 468 stabilize within the range shown by sample velocities 487*a–d*. This is the last sheet of a multiple run, and it is important to determine when sheet 11 moves past dryer 464 or 466, so that the increase in velocity 488 does not take place before the copy has been completely dried. Accordingly, while sheet 11 is under the dryer, a delay time is calculated equal to 4500/(DV), where 4500 is a constant that yields a delay sufficient to allow an eight-and-one-half-inch sheet to pass the dryer for any value of DV. At the end of this delay time both the thermal dryer 464 and the microwave dryer 466 are turned off. In addition, the exit motor 478 is then increased in velocity to load speed 484*b*.

If an exit sensor in assembly 17 is actuated, a REMOVE COPIES light is lit in display 230. In addition, after one second (for the copy to clear the exit path), output port 114 provides dropping signals on vacuum motor line 226 and TPT motor line 228, FIG. 3B, to servo motor 262. System 15 then returns to IDLE, paragraph 8.

If sheet 11 on drum 10 is not the last copy, system 15 goes to NEXT, paragraph 12, which is the routine that loads paper. As previously described, a new sheet 11 is then loaded, and a new print cycle is initiated.

The ERROR FLAGS are listed in paragraph 22 and need not be described in detail. It is understood that after an ERROR FLAG has been set, the ERROR routine is executed as set forth in paragraph 23. At this time dryers 464, 466 are turned off for safety purposes. In addition the PROFILE COMPLETE flag is reset, thereby producing a new profiling. After an ERROR, and during possible repairs, a sensor may be changed in position, or other changes may be made to copier system 15 which requires a new profiling.

Figure 11:
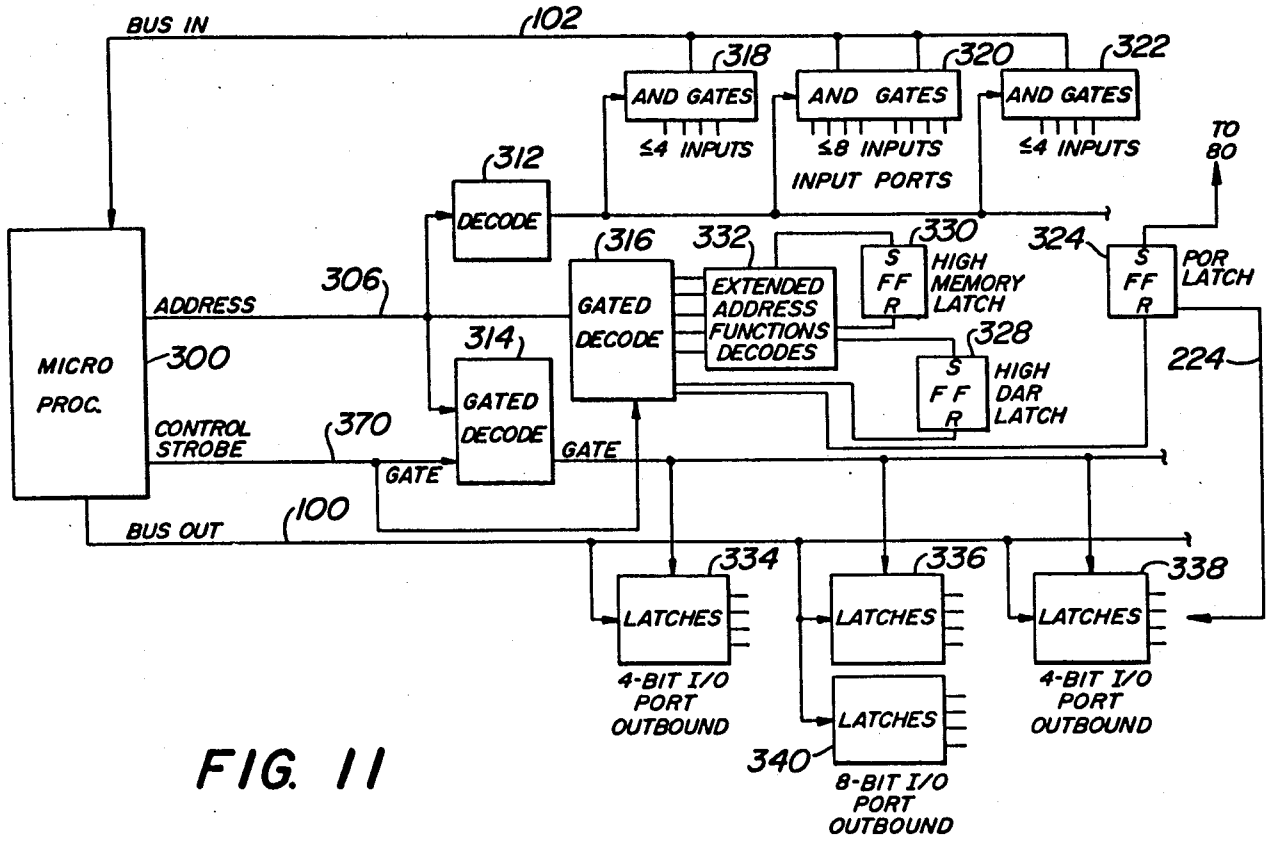
FIG. 11 is a detailed block diagram of the microprocessor and its busses and ports as shown in FIGS. 3A–B and 4.

Block diagram, FIG. 11, shows the physical implementation of microprocessor 300 and its busses, as well as input and output ports 104–107 and 110–114. Specifically, microprocessor 300 has an output data bus 100 and an input data 102, as well as an eight-bit address bus 306 and a control strobe line 370. Address bus 306 allows microprocessor 300 to address up to 256 input and output ports. Control strobe line 370 is used with bus 100 to set information into an output port shown, for example, in FIG. 11 as output gate latches 334, 336 and 338. Address bus 306 signals are decoded by decoder 314 to gate the output latches. Similarly, the addresses may be decoded by decoder 312 to select input ports which, for example, are shown as AND gates 318, 320 and 322, which are typical input ports. To extend memory address space, a gated decoder 316 is provided to control the addressing range of an extended address functions decode block 332. Furthermore, a power-on reset latch 324 is provided that is turned on whenever the power is brought up on system 15. Latch 324 resets all the output ports of microprocessor 300 until the latch 324 is reset by way of line 224.

Although the invention has been particularly shown and described with reference to a preferred embodiment thereof, it will be understood by those skilled in the art that various changes may be made therein without departing from the spirit or scope of the invention.

Figure 17:
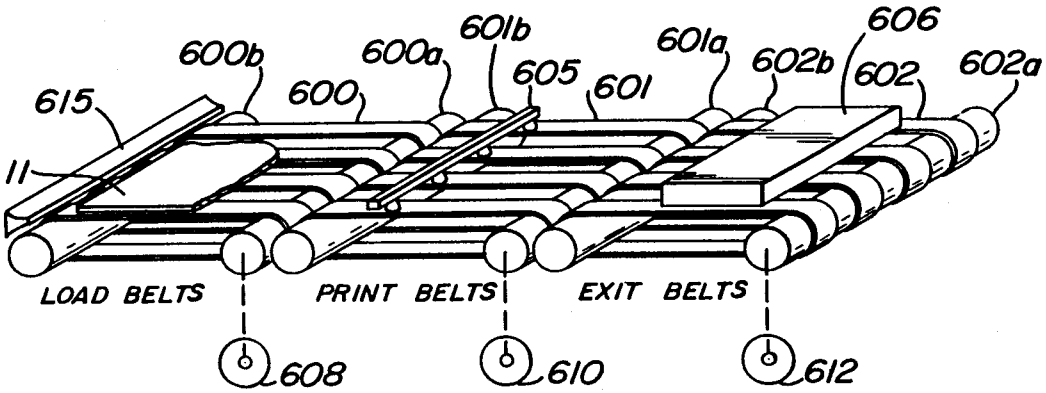
FIG. 17 is a perspective view of a flat transport assembly according to a still further embodiment of the invention.

For example, in a further embodiment of the invention, instead of drum 10, print belts 601 forming a horizontal flat bed may be used as shown in FIG. 17. With load belts 600 and exit belts 602 in juxtaposition with print belts 601 a flat horizontal transport assembly is formed. It will be understood that each of the belts 600–602 are segmented belts similar to belts 13 and 468 as shown in FIG. 1. Conveying belts 600 are mounted on driving roll 600*a* and idle roll 600*b*; belts 601 are mounted on driving roll 601*a* and idle roll 601*b*; and belts 602 are mounted on driving roll 602*a* and idle roll 602*b*. Belts 600–602 may each be driven by driving motors 608, 610 and 612 respectively.

It will be understood that sheet 11 remains flat for the entire pass, which includes the pass under array heads 605, and the entire printing is done in only one pass. In operation, as sheet 11 comes out of a conventional paper picker, it arrives at gate 615, where it waits until it is loaded on load belts 600. The middle belts or print belts 601 provide the same function as drum 10, and printing is accomplished in a single pass, thus requiring a substantial number of array heads 605. Motor 610 driving belts 601 may be similar to the motor and servo assembly 62 for drum 10, which is controlled as shown in FIGS. 3A–B to provide desired loading, printing and unloading speeds in accordance with print parameters. As in the case of drum 10, in which the time during which sheet 11 remains on the drum after printing may be varied, the unloading speed of sheet 11 from print belts 601 may be adjusted, to ensure drying.

When sufficiently dry, sheet 11 is then unloaded from print belts 601 and transferred to exit belts 602 driven by stepping motor 612. A thermal dryer 606 is disposed above belts 602, and sheet 11 is transported between the belts and the dryer. Motor 612 and dryer 606 are energized and controlled in manner similar to that used for motor 478 and dryer 464 as shown in FIGS. 2, 7.

Figure 8A:
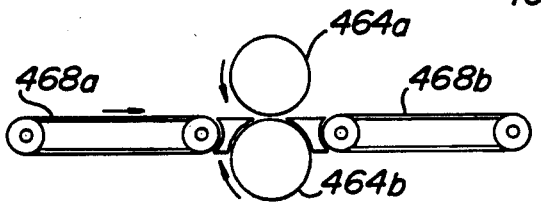
FIGS. 8A–8E show further embodiments of the invention having various types of dryers.
Figure 8B:
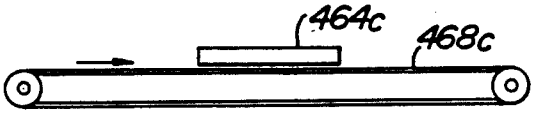
Figure 8C:
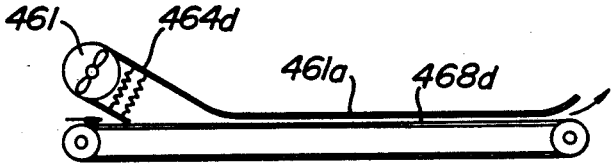
Figure 8D:
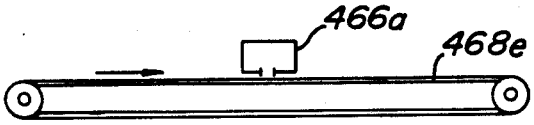
Figure 8E:
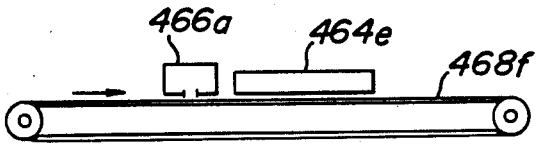

Still further embodiments are shown in FIGS. 8A–8E, which illustrate differing dryer configurations. In FIG. 8A rolls 464*a* and 464*b* are hot rolls controlled by power control 460 as shown in FIG. 7. In this embodiment the exit belts may be segmented, with a forward section 468*a* and a rearward section 468*b*. In the embodiment shown in FIG. 8B, the thermal dryer is a hot platen 464*c* having extended heat transfer surfaces spaced from belt 468*c*. In the still further embodiment of FIG. 8C. heat is produced by a fan 461 blowing over heating elements 464*d*, with the drying heat then being directed through a conduit 461*a* over exit belt 468*d*. FIG. 8D illustrates the wave guide 466*a* of microwave dryer 466 and shows the transmission of the microwave energy from the magnetron to the exit belt 468*e*. FIG. 8E shows the combination of both a thermal dryer 464*e* and a microwave dryer 466*a* with the purpose of combining both types of heating as previously explained.

While I have illustrated and described the preferred embodiments of my invention, it is understood that I do not limit myself to the precise constructions herein disclosed and the right is reserved to all changes and modifications coming within the scope of the invention as defined in the appended claims.

What is claimed is:

1. A printing system comprising storage means for providing electronic signals representative of print information to be printed, an ink jet printer having means for converting said electronic signals into print for printing a copy, means for determining from the electronic signals the density of print data for each individual copy as a measure of the wetness of the copy itself, said determining means providing the determination of print data density from the electronic signals for each individual copy substantially simultaneously with said ink jet printer converting said electronic signals into print for that individual copy, means for transporting each copy during printing, and means for controlling the detaching of each individual copy from the transporting means in accordance with the density of print data of that individual copy.

2. The apparatus of claim 1 in which said print data density determining means includes leading edge means for determining from the electronic signals the print data density of the leading edge of said copy and in which said controlling means includes means responsive to said leading edge determining means for determining the time of detaching in accordance with the print data density of the leading edge.

3. A printing system comprising storage means for providing electronic signals representative of print information to be printed, a printer having means for converting said electronic signals into print for printing a copy, means for determining as a print parameter from the electronic signals the density of print data for each individual copy as a measure of the wetness of the copy itself, said determining means providing the determination of print data density from the electronic signals for each individual copy substantially simultaneously with said printer converting said electronic signals into print for that individual copy, and means responsive to said determining means for controlling after printing the drying of each individual copy in accordance with the print data density of that individual copy.

4. The apparatus of claim 3 in which there is provided means for detecting the characteristics of said ink as a print parameter and in which said controlling means includes means responsive to said ink characteristics detecting means for also controlling said drying in accordance with said ink characteristics.

5. The apparatus of claim 3 in which there is provided means for detecting the ambient humidity as a print parameter and in which said controlling means includes means responsive to said humidity detecting means for also controlling said drying in accordance with said ambient humidity.

6. The apparatus of claim 3 in which there is provided means for drying said ink printed on each copy and said controlling means includes means for adjusting the drying provided by said drying means in accordance with the print parameters provided for that individual copy.

7. The apparatus of claim 6 in which there is provided exit means for receiving and transporting the printed media and said controlling means includes means for varying the speed of said exit means in transporting each copy in accordance with the print parameters provided for that individual copy thereby controlling the drying.

8. The apparatus of claim 6 in which said drying means includes means for heating said ink printed on each copy and said controlling means includes means for varying the heat provided by said heating means in accordance with the print parameters provided for that copy.

9. The apparatus of claim 8 in which said heating means includes a thermal platen responsive to applied energy and said controlling means includes means for varying the energy applied to said thermal platen in accordance with the print parameters of each individual copy.

10. The apparatus of claim 8 in which said heating means includes a microwave dryer responsive to applied energy and said controlling means includes means for sequencing on and off the energy applied to said microwave dryer in accordance with the print parameters of each individual copy.

11. The apparatus of claim 8 in which said heating means includes at least one hot roll responsive to applied energy and said controlling means includes means for varying the energy applied to said hot roll in accordance with the print parameters of each individual copy.

12. The apparatus of claim 3 in which there is provided means for transporting said copy during printing and in which said controlling means includes means for determining the time duration that said copy remains on the transporting means after printing in accordance with the print parameters of each individual copy thereby controlling the drying.

13. The apparatus of claim 12 in which said copy transporting means is a drum rotatable between a print speed and a load speed and in which said controlling means includes means for determining the number of additional revolutions the drum rotates at print speed prior to decelerating from print speed to load speed in accordance with the print parameters of each individual copy.

14. The apparatus of claim 13 in which there is provided means for varying the time of detaching of said copy from said drum in accordance with the print parameters of each individual copy.

15. The apparatus of claim 12 in which said copy transporting means includes a rotary transport and in which there is provided means for detaching the copy from the rotary transport responsive to said time duration determining means.

16. The apparatus of claim 15 in which leading edge means for determining from the electronic signals the print data density of the leading edge of each individual copy and in which said detaching means includes means responsive to said leading edge means for determining the time of detaching in accordance with the print data density of the leading edge.

17. The apparatus of claim 15 in which there is provided exit means for receiving and transporting the detached copy and in which there is provided means for heating said ink printed on each individual copy disposed adjacent said exit means and said controlling means includes means for varying the speed of said exit means as each copy is being transported adjacent said heating means in accordance with the print parameters of each individual copy.

18. The apparatus in claim 17 in which said controlling means includes means for varying the heat provided by said heating means in accordance with the print parameters of each individual copy.

19. The printing system of claim 3 in which there is provided document scanning means having a data memory for producing said electronic signals representative of print information to be printed and means coupling said data memory to said printer and to said determining means.

20. In a printing system including storage means for providing electronic signals representative of print information to be printed and including a printer having means for converting said electronic signals into print for printing a copy, a method of drying ink printed on each copy which comprises the steps of (a) determining as a print parameter from the electronic signals the density of print data for each individual copy as a measure of the wetness of the copy itself, (b) providing the determination of step (a) from the electronic signals from each individual copy substantially simultaneously with the printer converting the electronic signals into print for that individual copy, and (c) controlling after printing the drying of each individual copy in accordance with the print data density of that individual copy.

21. The method of claim 20 in which there is provided the further step of receiving and transporting each copy towards an exit and in which step (c) includes varying the speed of the transporting of each individual copy in accordance with the print data density for controlling the drying.

22. The method of claim 20 in which there is provided the further step of transporting the copy on a drum during printing and in which step (c) includes determining the time duration that the copy remains on the drum after printing in accordance with the print data density for controlling the drying of each individual copy.

23. The method of claims 20, 21 or 22 in which step (a) includes detecting the characteristics of the ink printed on a copy as a print parameter and step (c) includes controlling the drying in accordance with the ink characteristics.

24. The method of claims 20, 21 or 22 in which step (a) includes detecting the ambient humidity as a print parameter and step (c) includes controlling the drying in accordance with the ambient humidity.

25. The method of claim 22 in which step (a) includes determining from the electronic signals the print data density of the leading edge of the copy and in which step (c) includes determining the time of detaching in accordance with the print data density of the leading edge.

* * * * *

UNITED STATES PATENT AND TRADEMARK OFFICE

CERTIFICATE OF CORRECTION

PATENT NO. : 4,469,026

DATED : September 4, 1984

INVENTOR(S) : JOHN W. IRWIN

It is certified that error appears in the above-identified patent and that said Letters Patent are hereby corrected as shown below:

Column 1, line 5, insert --A microfiche appendix, comprising one microfiche with 45 frames, is available.--

Column 7, line 56, change "attached hereto" to --available as a microfiche appendix--.

Signed and Sealed this

*Twenty-fourth* Day of *September 1985*

[SEAL]

*Attest:*

*Attesting Officer*

DONALD J. QUIGG

*Commissioner of Patents and Trademarks—Designate*